US006114804A

United States Patent [19]

Kawase et al.

[11] Patent Number: 6,114,804

[45] Date of Patent: Sep. 5, 2000

[54] IMAGE APPARATUS HAVING RECESSED ENVELOPE FOR PLACEMENT OF ELECTRODE

[75] Inventors: Toshimitsu Kawase, Ebina; Naoto Nakamura, Isehara, both of Japan

[73] Assignee: Canon Kabushiki Kaisha, Tokyo, Japan

[21] Appl. No.: 09/044,906

[22] Filed: Mar. 20, 1998

[30] Foreign Application Priority Data

Mar. 21, 1997 [JP] Japan ..... 9-068175

[51] Int. Cl.[7] ..... H01J 63/04

[52] U.S. Cl. ..... 313/495; 422/477 HL

[58] Field of Search ..... 313/495, 477 HL, 313/583, 607, 631, 634, 422

[56] References Cited

U.S. PATENT DOCUMENTS

| | | | |
|---|---|---|---|
| 2,000,570 | 5/1935 | Nina | 250/27.5 |
| 5,525,861 | 6/1996 | Banno et al. | 313/495 |
| 5,760,538 | 6/1998 | Mitsutake et al. | 313/422 |

FOREIGN PATENT DOCUMENTS

| | | |
|---|---|---|
| 3-196455 | 8/1991 | Japan . |
| 4-94038 | 3/1992 | Japan . |
| 4-94043 | 3/1992 | Japan . |
| 4-98744 | 3/1992 | Japan . |
| 4-160741 | 6/1992 | Japan . |
| 4-163833 | 6/1992 | Japan . |
| 5-114372 | 5/1993 | Japan . |
| 6-139965 | 5/1994 | Japan . |
| 7-235255 | 9/1995 | Japan . |
| 1 444 162 | 7/1976 | United Kingdom . |

*Primary Examiner*—Vip Patel
*Attorney, Agent, or Firm*—Fitzpatrick, Cella, Harper & Scinto

[57] ABSTRACT

An image-forming apparatus comprises in a vacuum envelope an electron source including a plurality of electron-emitting devices and an image-forming member including a fluorescent layer and a high voltage anode layer disposed vis-a-vis the electron source. The envelope may preferably have a low resistance electroconductive member electrically connected to the ground by way of a low impedance ground connection line for by-passing large electric current which may occur upon electric discharge between the anode layer and the electron source and can possibly destroy the electron-emitting devices if flowing thereinto by way of the driving wires of the devices. The high voltage anode layer and/or the low resistance electroconductive member is drawn out from the inside of the envelope to a recess formed in the outer surface of the envelope and is electrically connected to external wiring in the recess.

31 Claims, 14 Drawing Sheets

IMAGE APPARATUS HAVING RECESSED ENVELOPE FOR PLACEMENT OF ELECTRODE

BACKGROUND OF THE INVENTION

1. Field of the Invention

This invention relates to an image-forming apparatus such as an image display apparatus. It also relates to a method of manufacturing such an apparatus.

2. Related Background Art

CRTs (cathode ray tubes) are typical image-forming apparatus that utilize electron beams and have been used widely long since.

In recent years, flat type display apparatus have been gaining in popularity, replacing gradually CRTs. However, they are not emission type and accompanied by a number of problems including the need of a back light and hence there has been a strong demand for emission type display apparatus. While plasma displays are commercially available currently as emission type displays, they are based on a principle different from CRTs for light emission and are not comparable in terms of the contrast of the displayed image and the coloring performance of the apparatus. Meanwhile, efforts have been paid for research and development in the field of realizing a flat type image-forming apparatus by arranging a plurality of electron-emitting devices that is comparable with a CRT in terms of the quality of the displayed image. For example, Japanese Patent Application Laid-Open No. 4-163833 discloses a flat type electron beam image-forming apparatus realized by containing linear thermionic cathodes and complex electrode structures in a vacuum envelope.

With an image-forming apparatus comprising an electron source, the electron beams emitted from the electron source to strike an image-forming member can partly collide with the inner wall of the vacuum envelope to make it emit secondary electrons and become charged up to raise the electric potential at the local areas of the Inner wall hit by electron beams. Then, the vacuum envelope shows a distorted potential distribution to produce not only unstable electron beam trajectories but also internal electric discharges to degrade and eventually destroy the apparatus.

Known methods of preventing charge-ups include forming an anti-charge film on the inner wall of the vacuum envelope of the apparatus. Japanese Patent Application Laid-Open No. 4-163833 discloses an image-forming apparatus comprising an electroconductive layer of a high impedance electroconductive material arranged on the lateral sides of the inner wall of the glass envelope of the apparatus.

In an image-forming apparatus utilizing electron beams, a voltage is applied between the electron source and the image-forming member of the apparatus to accelerate electrons emitted from the electron source. If the vacuum envelope of the image-forming apparatus is made of soda lime glass or some other glass containing sodium (Na), Na ions are forced to move by the electric field that is generated by the applied voltage to give rise to an electrolyzing current. A vacuum envelope using glass is typically prepared by bonding a number of members by means of frit glass. As Na ions are forced to flow into the frit glass of the vacuum envelope by an electrolyzing current, PbO contained In the frit glass is reduced to deposit Pb and produce cracks in the frit glass so that the vacuum condition in the envelope can become damaged. A technique for preventing such a situation is to provide the vacuum envelope with an electrode at an appropriate location on the outer wall thereof to attract the electrolyzing current that can otherwise flow into the frit glass. For example, Japanese Patent Application Laid-Open No. 4-94038 proposes the use of a low resistance electroconductive film arranged along the periphery of the face plate and connected to the ground to prevent any electrolyzing current from flowing into the frit glass of the vacuum envelope. U.S. Pat. No. 5,357,165 discloses the use of a stripe-shaped electrode for causing an electric current to flow along the lateral wall of the vacuum envelope and producing a gradient of electric potential.

FIG. 15 of the accompanying drawings shows an equivalent circuit for the above known arrangement. In FIG. 15, spot 71 represents the image-forming member to which voltage Va is applied and spot 72 represents the junction of the components of the vacuum envelope, while resistor 75 has an electric resistance equal to that of the anti-charge film formed on the inner wall of the vacuum envelope between 71 and 72. Spot 73 represents the wire extending from the inside of the vacuum envelope to the outside through the junction of the components to drive the electron source and the electric resistance of the frit glass between 72 and 73 is equal to that of resistor 76. The wire is connected to the terminal 79 of the power source for driving the electron source that shows a given electric potential. The resistance of the wire is equal to that of resistor 80. The electrolyzing current flowing from the image-forming member 71 to the junction 72 through the inside of the glass of the vacuum envelope experiences electric resistance the magnitude of which is equal to that of the electric resistance of resistor 77. Reference numeral 74 denotes an electrode arranged outside the vacuum envelope for capturing the electrolyzing current. The electrolyzing current flowing through the inside of the glass encounters electric resistance having a magnitude equal to that of the electric resistance of resistor 78. The electrode 74 is connected to the ground by way of the resistance of the conductor connected to it. The junction 72 is connected to member 82 having a given electric potential, experiencing electric resistance whose magnitude is equal to that of the resistance of resistor 81.

Note that, while FIG. 15 shows a possible equivalent circuit for a known arrangement for avoiding charge-ups in an image-forming apparatus, it may not accurately correspond to the arrangement in a rigorous sense of the word.

However, a flat type electron beam image-forming apparatus as described in Japanese Patent Application Laid-Open No. 4-163833 is in fact not very flat and has a considerable depth because the glass envelope of the apparatus contains specifically designed structures including horizontal and vertical deflecting electrodes in it. On the other hand, there is a demand for electron beam image-forming apparatus to be used as portable information processing terminals that are as flat and light weight as a liquid crystal display.

In line with the efforts for realizing very flat image-forming apparatus, the applicant of the present patent application has achieved a number of improvements for surface conduction electron-emitting devices and image-forming apparatus comprising such devices. For example, Japanese Patent Application Laid-Open No. 7-235255 describes an electron-emitting device having a simple configuration. Such devices can be arranged over a relatively large area in large numbers to realize a very flat electron beam image-forming apparatus without using complex structures such as electrode structures In an image-forming apparatus of the type under consideration, a voltage is applied between the electron source and the image-forming member to accelerate electrons. If ordinary fluorescers are used for the image-forming member, this voltage is desirably raised at least to a level of several kV in order to provide the emitted light with a desired coloring effect. Then, the use of a specifically designed voltage supply terminal having a connection structure that can prevent electric discharges and deal with high voltages will be required to apply a voltage of several kV to the image-forming member.

Meanwhile, a flat type electron beam image-forming apparatus requires a voltage supply terminal having a connection structure for applying a voltage to members within the vacuum envelope such as an anode that is structurally different from the connection structure of a CRT. As for connection terminals of the type under consideration, Japanese Patent Application Laid-open No. 5-114372 proposes an arrangement of using a metal rod running through the glass plate of the back side of the vacuum envelope, sealing the gap between the glass plate and the metal rod with frit glass and keeping the resilient front end of the metal rod physically in contact with the metal back layer of the image-forming section within the vacuum envelope. Japanese Patent Application Laid-Open No. 4-160741 proposes an arrangement of using a terminal connecting section connected to the inside of the vacuum envelope by means of an electroconductive adhesive agent. An arrangement of using a connection terminal connected to the inside of the vacuum envelope and drawn out through a lateral side of the vacuum envelope is described in Japanese Patent Application Laid-Open No 4-94038. Similar arrangements are disclosed in Japanese Patent Applications Laid-Open Nos. 4-98744 and 6-139965. Japanese Patent Application Laid-Open No. 4-94043 describes an arrangement for a connection terminal that runs through a through hole which is bored through the face plate and is connected to the inside of the vacuum envelope.

With any of the above arrangements, the terminal is connected to a high voltage feed-in wire within the vacuum envelope. Now, the vacuum envelope is exposed to high temperature during the operation of assembling it as frit glass applied thereto to hermetically seal the components of the vacuum envelope. Then, the junction of the high voltage feed-in wire and the connection terminal is also exposed to high temperature so that, If an adhesive agent is used to the junction, the impurities contained in the adhesive agent can be released therefrom to adversely affect the electron emitting performance of the apparatus. If, on the other hand, they are held resiliently in contact with each other, the resilience of the resilient member can be degraded and/or a defective connection can occur due to faulty handling or fitting operation during the assembling process. Once the image-forming apparatus is assembled, it is practically impossible to correct the connection if it is found faulty so that the time and labor consumed for the assemblage is reduced to nil to lower the manufacturing yield of the line.

Thus, the reliability of the connection of the high voltage terminal within the vacuum envelope is not highly reliable and a poor reliability inevitably reduces the manufacturing yield of the line. Particularly, if the connecting section where a high voltage is fed is faulty, the entire image-forming apparatus can remain inactive to make the apparatus useless. To avoid such a situation, a rigorous line control system will have to be implemented to raise the cost of controlling the line.

The arrangement of providing the flat type image-forming apparatus with a projection at a lateral side for electric connection is also accompanied by problems including that the cabinet holding the apparatus is forced to become bulky in order to accommodate the projection if the apparatus is a TV set. While this problem may be alleviated when the projection is located at the front or rear side, problems may also arise in terms of the design of the cabinet, the assembling process and so on to raise the manufacturing cost.

Another problem for a flat type image-forming apparatus to cope with a high voltage is a high risk of electric discharges that can occur along the inner wall of the vacuum envelope due to the reduced distance between the image-forming member and the electron source of the apparatus. A very large electric current is flows instantaneously when an electric discharge occurs and the electron-emitting devices of the electron source can be subjected to a very high voltage when the electric current flows, if partly, into some of The wires of the electron source. When the voltage exceeds an allowable level for the normal operation of the electron-emitting devices, their performance can become degraded and, in some cases, some of the devices can become destroyed. Then, the image displayed on the image-forming apparatus can be lost, if partly, to remarkably degrade the quality of the image and make the image-forming apparatus no longer operational.

Thus, the problems to be solved for arranging a connection terminal on a flat type electron beam image-forming apparatus include the following.

(1) It ensures a reliable electric connection.

(2) It does not need a projection at a lateral side of the vacuum envelope.

(3) It does not adversely affect the atmosphere in the vacuum envelope.

Thus, there is a strong demand for highly reliable flat type electron beam image-forming apparatus that are free from the above identified problems.

SUMMARY OF THE INVENTION

Therefore it is an object of the present invention to provide an image-forming apparatus having a novel arrangement for drawing out the electrode terminal extending from the image-forming means arranged within the vacuum envelope of the apparatus to the outside of the vacuum envelope.

Another object of the present invention is to provide an image-forming apparatus having a novel arrangement for drawing out the electrode terminal that ensures a reliable electric connection.

Still another object of the present invention is to provide an image-forming apparatus having a novel arrangement for drawing out the electrode terminal that does not need a remarkable projection at the outer periphery of the vacuum envelope.

A further object of the present invention is to provide an image-forming apparatus having a novel arrangement for drawing out the electrode terminal that does not adversely affect the atmosphere in the envelope.

According to the invention, the above objects and other objects are achieved by providing an image-forming apparatus comprising an envelope and an image-forming means disposed within the envelope, characterized in that said envelope has a recess on the outer wall thereof and a feed-in electrode is arranged in the recess and electrically connected to the image-forming means.

DETAILED DESCRIPTION OF THE PREFERRED EMBODIMENTS

Now, the present invention will be described by way of preferable modes of carrying it out.

In the modes of carrying out the invention, there is provided an image-forming apparatus comprising an envelope and an image-forming means disposed within the envelope and including an electron source and an image-forming member that produces images when irradiated with electrons emitted from the electron source.

Figure 1:
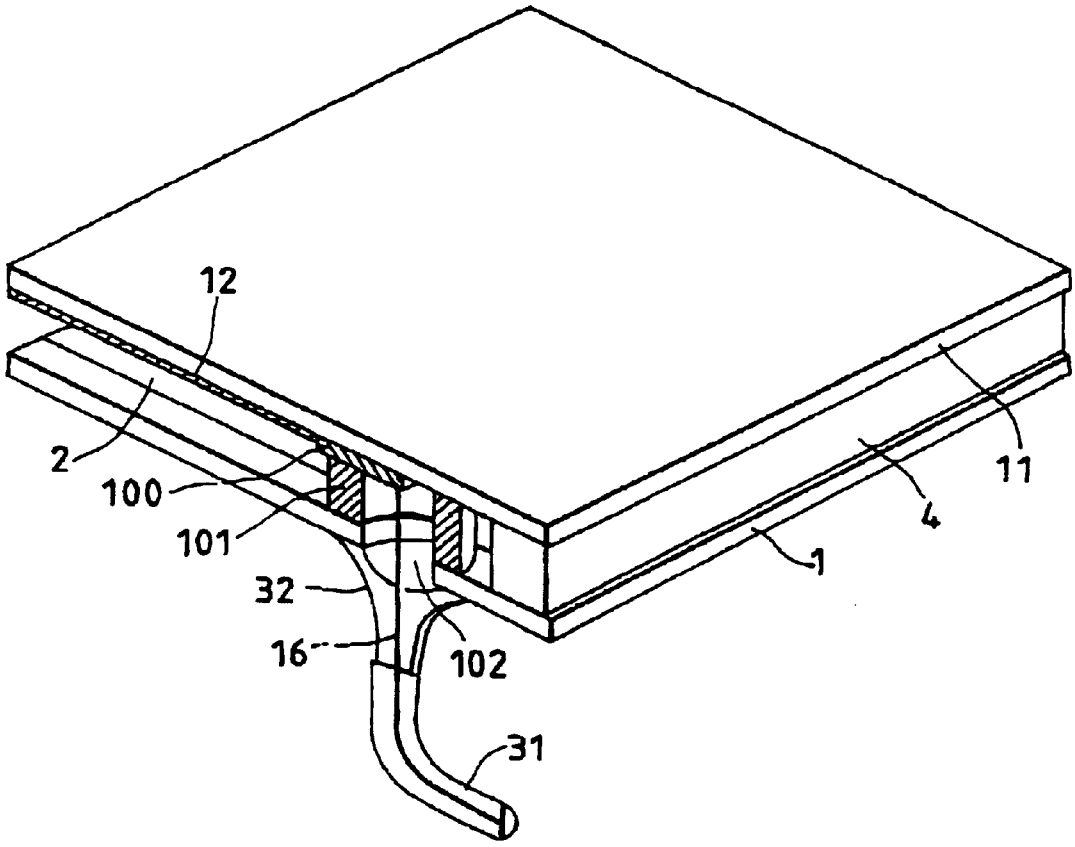
FIG. 1 is a partly cut out schematic perspective view of an image-forming apparatus according to the invention, showing the opening for the high voltage connector.

Firstly, the structure of the terminal drawing out unit of an image-forming apparatus according to the invention will be described. FIG. 1 schematically illustrates the unit, which is adapted to a connection terminal. Here, a structure for a high-voltage feed-in terminal will be illustrated as an example. The envelope of the apparatus comprises a rear plate 1 and a face plate 11. A hollow member 101 is formed by baking and securing frit (not shown) between the through hole 102 of the rear plate 1 and the face plate 11 carrying thereon an image-forming member 12. The image-forming member 12 is partly drawn out from the inside of the vacuum envelope to the atmosphere by way of a drawn-out wire 100. Thus, the high voltage terminal 16 of the apparatus is electrically connected in the atmosphere to the drawn-out wire 100 of the image-forming member 12 arranged on the face plate 11.

The terminal 16 and the drawn-out wire may be connected in various different ways. For example, they may be held in physical contact by means of the resiliency of a spring. Alternatively, they may be bonded together by means of solder. Still alternatively, they may be connected by using both physical means and laser welding. With any of these arrangement, the high voltage terminal 16 can be connected to and disconnected from the drawn-out wire 100 after completing the preparation of the vacuum envelope so that they do not have to be connected during the operation of assembling the vacuum envelope and the risk of faulty connection can be avoided to improve the yield of manufacturing image-forming apparatus.

Preferably, the through hole 102 is filled with an insulating resin material such as silicone resin and a rubber cap 32 typically made of silicone is arranged thereon to cope with external electric discharges more satisfactorily. Additionally, the terminal is connected to an external flyback transformer by way of a cable 31 that can withstand high voltage. With this arrangement, no creeping discharges will occur when an electric conductor is located close to the connection terminal. The airtightness of a vacuum envelope will be improved at and around the hollow member if the hollow member 101 is bonded by means of frit glass to produce a two-layered structure of crystalline frit glass and non-crystalline frit glass.

The vacuum envelope may be made to cope with electric discharges more satisfactorily in a manner as will be described below.

The vacuum envelope is provided on the inner wall surface thereof with an anti-charge film and a low resistance electric conductor arranged around the electron source to cross the current flow path along the inner wall surface of the vacuum envelope between the electron source and the image-forming member. A low resistance electric conductor is connected to the ground by way of a low impedance electric current flow path (referred to as "ground connection line" hereinafter). While it is preferable that the ground connection line has an impedance as small as possible, the most important requirement to be met by the ground connection line is that, if an electric discharge occurs, the discharge current generated by the electric discharge mostly flows to the ground through the low resistance electric conductor and the ground connection line to sufficiently reduce the electric current flowing into the electron source.

To what extent the discharge current flows through the low resistance electric conductor and the ground connection line depends on the ratio of the impedance of the electric current flow path to that of the other electric current flow paths (represented by Z and Z' respectively hereinafter) and, since the impedance varies as a function of frequency, it is necessary to look into the frequency components of the electric discharge. As a result of experiments conducted to observe the electric discharge occurring along the inner wall of the vacuum envelope of a flat type electron beam image-forming apparatus, it was found that, while the electric discharge typically lasts for several microseconds, a large discharge current can flow only for less than a tenth of the duration of the electric discharge or about 0.1 microseconds.

Therefore, Z should be sufficiently smaller than Z' for a frequency less than 10 MHz. The frequency components greater than 10 MHz diminish gradually but due to quick rising nature of electric discharge, such frequency components typically include those close to 1 GHz. Therefore, Z should be sufficiently smaller than Z' for a frequency less than 1 GHz in order to reliably avoid damages due to an electric discharge.

As will be described hereinafter, this requirement is satisfactorily met when the resistance of the ground connection line is less than 1/10, preferably less than 1/100, of the resistance of any other electric current flow paths.

Figure 14A:
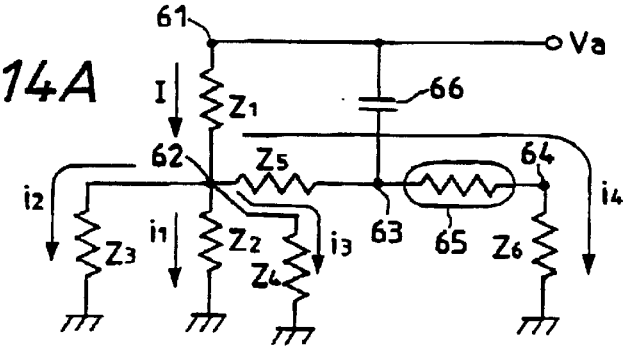
FIG. 14A is a circuit diagram of an equivalent circuit to be used for illustrating the effect of the present invention.
Figure 14B:
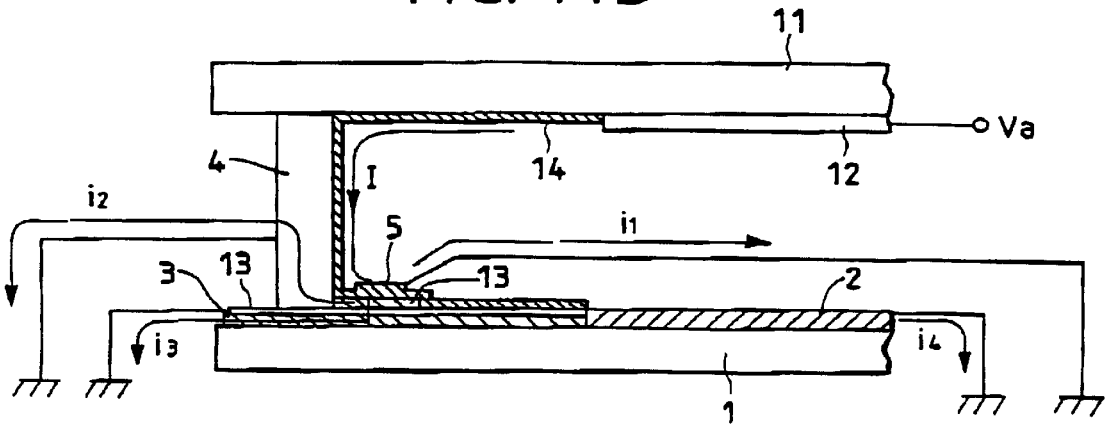
FIG. 14B is a schematic partial cross sectional view of an image-forming apparatus according to the invention, illustrating the correspondence with the equivalent circuit of FIG. 14A.
Figure 15:
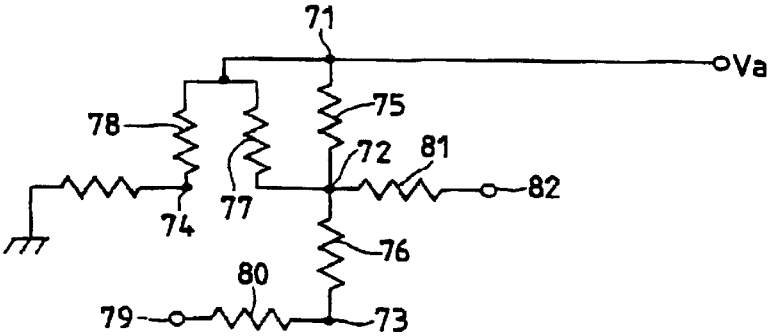
FIG. 15 is a circuit diagram of an equivalent circuit for a comparable known arrangement.

FIG. 14A is a circuit diagram of a simplified equivalent circuit illustrating the electric currents that appear when an electric discharge occurs in an image-forming apparatus according to the invention. FIG. 14B is a schematic partial cross sectional view of an image-forming apparatus corresponding to the equivalent circuit of FIG. 14A, also showing the electric currents that appear when an electric discharge occurs in the apparatus. In FIG. 14B, there are shown a rear plate 1, an electron source 2, electron source drive wires 3, a support frame 4, a low resistance electric conductor 5, a face plate 11, an image-forming member 12 and an insulating member 13. The insulating member 13 may be an insulation layer formed by printing or an insulator panel of glass or ceramic. The insulating member 13 may be entirely produced by applying glass paste by means of a printing technique and then baking the paste. Alternatively, a glass or ceramic plate may be used as part of the insulating member 13 in order to provide the latter with a sufficient degree of insulation and prevention of dielectric breakdown. In this embodiment, an anti-charge film 14 is arranged on the inner wall of the vacuum envelope. Note that, in FIG. 14A, point 61 corresponds to the image-forming member 12 and point 62 corresponds to the low resistance electric conductor 5, whereas point 65 represents an electron-emitting device of the electron source and points 63 and 64 represent the respective opposite electrodes of the electron-emitting device. While the electron source normally comprises a plurality of electron-emitting devices, only a single device is shown in FIG. 14A for the purpose of simplicity. Reference numeral 66 denotes the capacitance between the image-forming member 12 and the electron source 2.

Reference symbol $Z_1$ denotes the impedance between the image-forming member 12 and the low resistance electric conductor 5, which is relatively large due to the anti-charge film 14 under normal conditions (where there is no electric charge) but falls effectively and remarkably to cause electric current I to flow once an electric discharge occurs. Reference symbol $Z_2$ denotes the impedance for electric current $i_1$ flowing from the low resistance electric conductor 5 itself down to the ground. Reference symbol $Z_3$ denotes the impedance for electric current $i_2$ flowing through the insulation layer, the glass of the vacuum envelope, the frit glass used for bonding and the supports of the image-forming apparatus down to the ground, although this electric current can be made very small and negligible when a sufficiently large resistance is selected for the insulation layer. Reference symbol $Z_4$ denotes the impedance for electric current $i_3$ flowing through the anti-charge film 14 into the electron source and then further down to the ground through the electron source drive wires 3. Reference symbol $Z_5$ denotes the impedance for electric current $i_4$ flowing through the anti-charge film 14 into the electron source and then into the electron-emitting device 2. Reference $Z_6$ denotes the impedance for the electric current (denoted also by $i_4$) flowing through the electron-emitting device 2 and then down to the ground by way of the line at the opposite end of the device 2. Note that the equivalent circuit of FIG. 14A is a simplified expression of the embodiment showing only the element that are most significant for the purpose of the invention, although, rigorously speaking, the embodiment involves complex factors such as the fact that the electron source drive wires 3 are connected to an electron source drive circuit and a capacitive coupling may exist between any two components.

For the purpose of the invention, once a discharge current appears and flows into the low resistance electric conductor, most of it should be made to flow to the ground by way of the ground connection line (as electric current $i_1$) to sufficiently reduce the remaining currents $i_2$, $i_3$ and $i_4$. Note that, of the electric currents, the electric current $i_4$ is the one that can damage the electron-emitting device. While not pointed out above, the electric current $i_2$ can damage the vacuum envelope and the frit glass in the apparatus, although it can be made low by selecting a sufficiently large resistance for the insulation layer as described above. Thus, the impedance $Z_2$ corresponds to the impedance Z described earlier and the composite impedance of $Z_3$ through $Z_6$ corresponds to the impedance Z' in the earlier description. While a small value of the ratio (Z/Z') is effective for the purpose of the invention, a value of $(Z/Z') \leqq 1/100$ is required for frequencies below 10 MHz. A value of $(Z/Z') \leqq 1/10$ will make the effect of the invention more reliable Preferably, the relationship of $(Z/Z') \leqq 1/10$ holds true for frequencies below 1 GHz.

While the anti-charge film is arranged on the inner wall of the vacuum envelope in the above description and such an arrangement is effective for reducing the possibility of appearance of charge-ups and hence provides a preferred mode of carrying out the invention, the anti-charge film may not necessarily be arranged in such a way. While the anti-charge film should show a certain degree of electroconductivity because it is useless if it shows a large sheet resistance, a large electric current can flow between the image-forming member and the low resistance electric conductor to increase the power consumption of the apparatus under normal conditions where there is no electric charge. Therefore, it should have a sheet resistance as large as possible within a limit for keeping it effective Although the sheet resistance may vary depending on the configuration of the image-forming apparatus, it is preferably found within a range between $10^8$ and $10^{10}\Omega/\square$.

The low resistance electric conductor of an image-forming apparatus according to the invention is arranged to totally surround the electron source in order to make it operate most reliably, although it may be arranged in many different ways. For example, it may be arranged only on the side(s) of the electron source that can easily give rise to electric discharges. If the momentum of some of the electrons emitted from the electron-emitting devices of the electron source has a component directed in a specific direction along the surface of the rear plate, most of the electrons reflected and scattered by the image-forming member will collide with a portion of the inner wall of the vacuum envelope located at the end of the specific direction so that an electric discharge will most probably occur at that portion. Therefore, the low resistance electric conductor will be highly effective if it is arranged only on the side of the electron source where that portion is located.

Of the ground connection line of an image-forming apparatus according to the invention, the portion that connects the inside and the outside of the vacuum envelope (hereinafter referred to as "ground connection terminal") may take various forms provided that it shows a sufficiently low impedance. For example, a wire may be arranged for the ground connection line without significant difficulty on the rear plate between the low resistance electric conductor and an end of the rear plate and then made to pass between the rear plate and the support frame that are bonded to each other by frit glass. While the wire preferably has a large width and a large height from the viewpoint of reducing the impedance of the wire, it can obstruct the assemblage of vacuum envelope if it is too high. While the wire may have a width slightly less than that of the rear plate along which the wire is arranged, a large capacitance can be produced between the wire and the electron source drive wires to adversely affect the operation of driving the electron source if the electron source drive wires are arranged on the wire having such a large width with an insulation layer interposed therebetween to form a multilayer structure. Then, measures has to be taken to eliminate such a large capacitance. It may be preferable to arrange the ground connection terminal in an area where no electron source drive wire is located.

Although the use of a wide wire to reduce the impedance of the ground connection terminal is also effective for preventing part of the discharge current from leaking into and damaging the frit glass, this effect can be made more reliable when the ground connection terminal is realized in the form of a sufficiently large metal rod running through a through hole formed in the face plate or the rear plate and coated with an insulating material such as alumina or ceramic that does not allow any ionic current to flow therethrough.

It is preferable from the design point of view to make both the high voltage connection terminal for connecting the image-forming member to a high voltage source and the above described ground connection terminal of an image-forming apparatus run through a through hole formed in the rear plate when applying the apparatus to a TV receiving set because the connections with the high voltage source and the ground are then found on the rear side of the image-forming apparatus, although measures may have to be taken against electric discharges that can take place on the front surface of the insulation layer due to the high voltage applied between the insulator coat of the high voltage connection terminal and the rear plate. A low resistance electric conductor will also have to be arranged around the through hole of the high voltage connection terminal and electrically connected to the low resistance electric conductor arranged around the electron source Alternatively, the two low resistance electric conductors may be made into integral parts of a single conductor.

Now, a preferred mode of carrying out the invention will be described by referring to the drawings.

FIG. 1 is a schematic perspective view of an image-forming apparatus according to the invention, illustrating the terminal drawing out unit. The drawn-out terminal may be either for applying a high voltage or for connecting to the ground line, although the former will be described here.

A ring-shaped hollow member 101 is placed with frit glass between the through hole 102 bored through the rear plate 1 and the face plate 11 and baked to securely hold it in place and produce a recess there.

The airtightness of the vacuum envelope will be improved if the hollow member 101 is bonded by means of frit glass to produce a two-layered structure of crystalline frit glass and non-crystalline frit glass.

The terminal (high voltage terminal) 16 to be used for applying a high voltage to the image-forming member 12 is connected to the drawn-out wire 100, which is arranged in the opening of the hollow member 101 and drawn out from the inside of the vacuum envelope to the atmosphere as viewed from the rear plate 1 side when the face plate 11 end the rear plate 1 are aligned The high voltage terminal 16 is electrically connected to the drawn-out wire 100 of the image-forming member 12 arranged on the face plate 11 in the atmosphere after the vacuum envelope is prepared. The high voltage terminal 16 may be made of an electrically highly conductive material such as Ag or Cu. Techniques that can be used for connecting the high voltage terminal 16 include laser welding, the use of an electroconductive adhesive agent and metal bonding, although a preferable choice may be that the terminal is provided at the front end thereof with a spring structure so that it may be resiliently held in contact with the drawn-out wire 100. The distance of the atmospheric gap between the high voltage terminal 16 and the hollow member 101 should be selected as a function of the voltage of the terminal because electric discharges likely occur more often when the voltage is high.

With the above described arrangement, the high voltage terminal 16 can be connected to and disconnected from the drawn-out wire 100 after the vacuum envelope is completed.

The hollow member 101 may take various forms such as ring-shaped, rectangular and so on, although the use of a ring-shaped hollow member will be most suitable because it is not likely to give rise to a concentrated electric field. When a high voltage feed-in opening is formed, the hollow member 101 is preferably made of an insulating material that substantially prohibits the flow of an electrolyzing current such as glass containing sodium to a reduced concentration or ceramic. Ceramic provides a highly preferable material for the hollow member 101 because an electric current can hardly flow due to ionization in the inside of the material if subjected to an electric field and degradation of the frit glass used for sealing the hollow member 101 can be effectively suppressed.

The through hole 102 is filled with an insulating resin material such as silicone resin and a rubber cap 32 typically made of silicone resin is arranged thereon to cope with external electric discharges more satisfactorily. Additionally, the terminal is connected to an external flyback transformer by way of a cable 31 that can withstand high voltage. With this arrangement, no creeping discharges will occur when an electric conductor is located close to the connection terminal.

Figure 2:
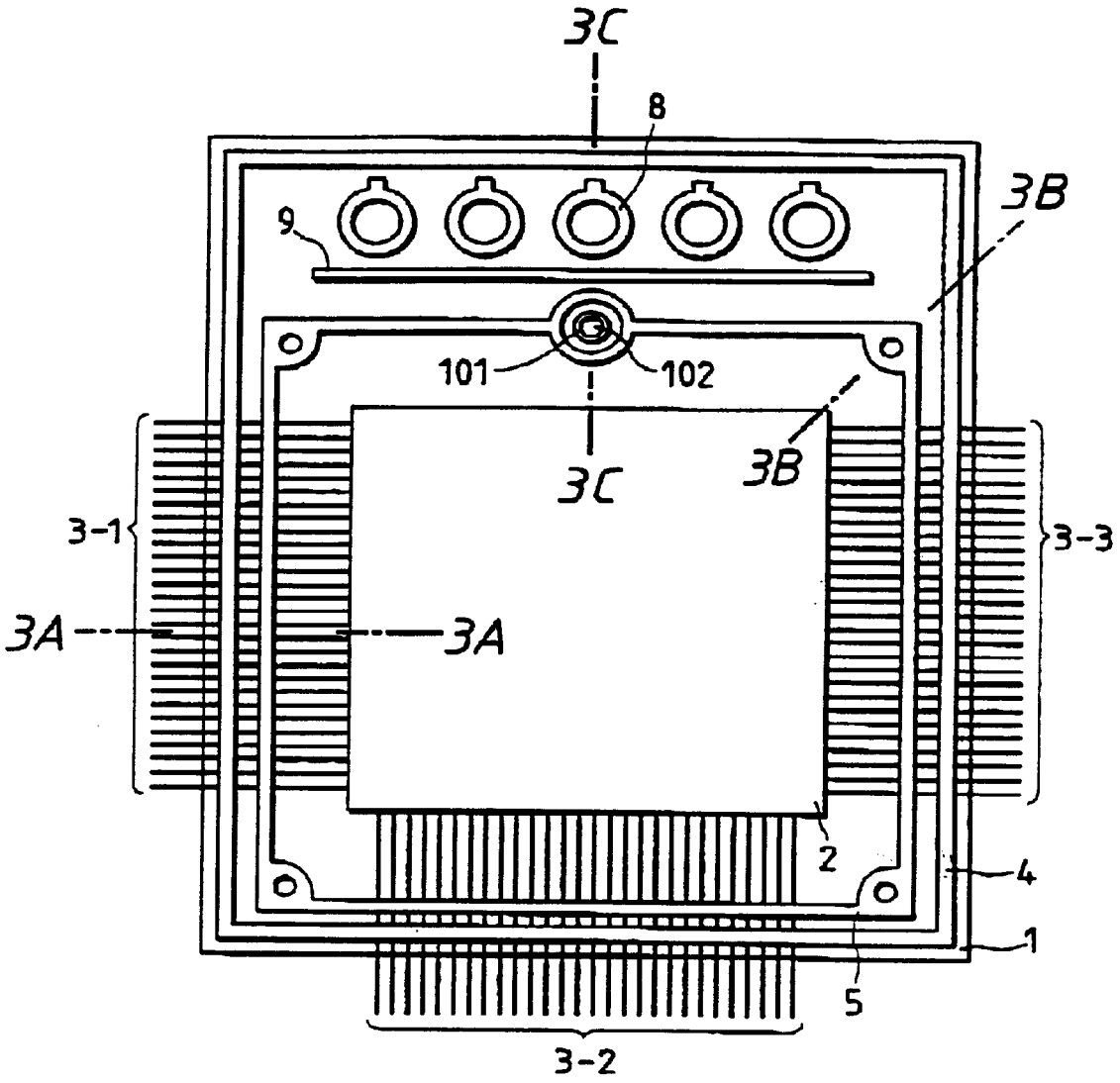
FIG. 2 is a schematic plan view of an embodiment of image-forming apparatus according to the invention, showing the arrangement of the rear plate and the support frame.

FIG. 2 is a schematic plan view of an embodiment of image-forming apparatus according to the invention, showing the internal arrangement by removing the face plate. The embodiment of FIG. 2 has a structure suitably coping with internal vacuum discharge. Referring to FIG. 2, reference numeral 1 denotes a rear plate 1 designed to operate as the substrate of the electron source and made of a material selected from soda lime glass, soda lime glass coated on the surface with an $SiO_2$ layer, glass containing Na to a reduced concentration, quartz glass and ceramic according to the conditions under which it is used. Note that a separate substrate may be used for the electron source and bonded to the rear plate after preparing the electron source. Reference numeral 2 denotes an electron source region where a plurality of electron-emitting devices such as field emission devices or surface conduction electron-emitting devices are arranged and wired appropriately so that they may be driven appropriately according to the application of the apparatus. Reference symbols 3-1, 3-2 and 3-3 denote wires to be used for driving the electron source, which are partly drawn to the outside of the vacuum envelope and connected to an electron source drive circuit (not shown). Reference numeral 4 denotes a support frame held between the rear plate 1 and the face plate (not shown) and bonded to the rear plate 1 by means of frit glass. The electron source drive wires 3-1, 3-2 and 303 are buried into frit glass at the junction of the support frame 4 and the rear plate 1 and are then drawn to the outside of the vacuum envelope. Reference numeral 5 denotes a low resistance electric conductor that is arranged around the electron source region 2. An insulation layer (not shown) is arranged between the low resistance electric conductor 5 and the electron source drive wires 3-1, 3-2 and 3-3. Reference numeral 102 denotes a through hole that allows the high voltage terminal for applying a high voltage to the image-forming member on the face plate to be connected to the member in the atmosphere after assembling the vacuum envelope. Reference numeral 102*a* denotes the insulating material filled into the through hole 102 after connecting the high voltage terminal to the image-forming member and reference numeral 101 denotes the hollow member that forms the through hole and held in position between the rear plate 1 and the face plate (not shown) by means of frit glass. A getter 8 and a getter shield plate 9 may be arranged within the vacuum envelope as shown in the drawing, along with other components if necessary.

Figure 3A:
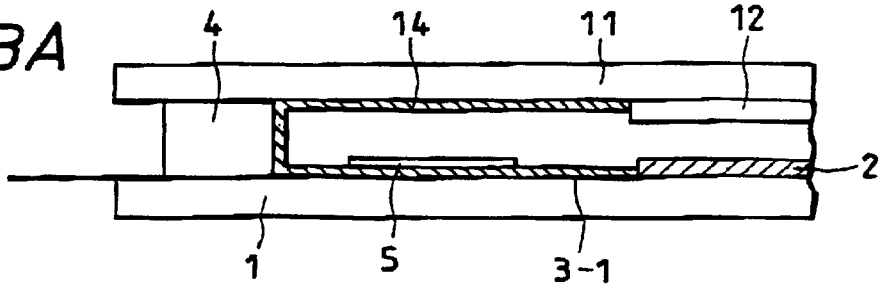
FIGS. 3A, 3B and 3C are schematic partial cross sectional views of the embodiment of FIG. 2 taken along lines 3A—3A, 3B—3B and 3C—3C in FIG. 2 respectively.
Figure 3B:
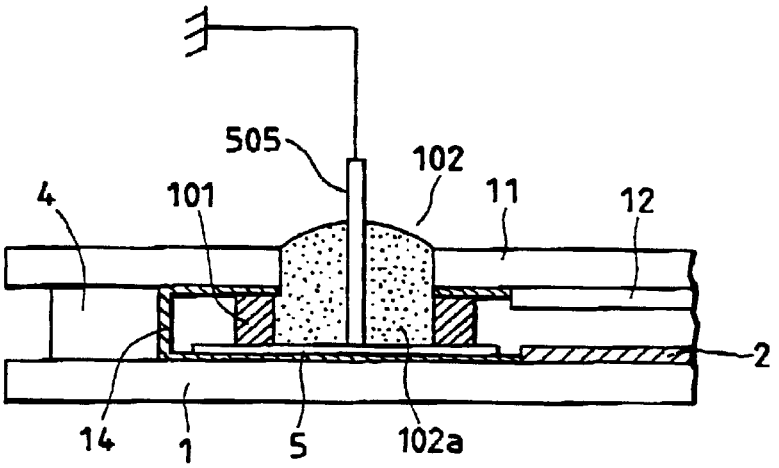
Figure 3C:
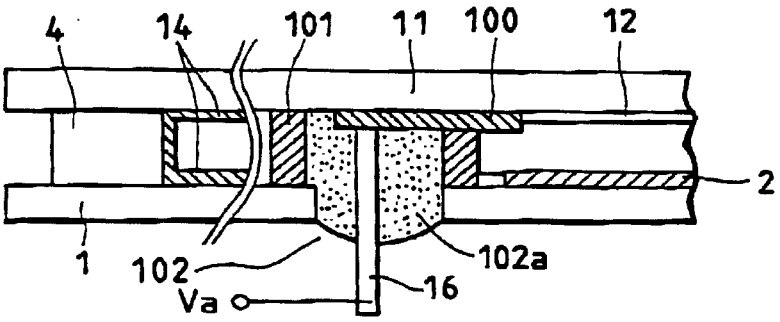

FIGS. 3A, 3B and 3C show schematic partial cross sectional views of the embodiment of FIG. 2 taken along lines 3A—3A, 3B—3B and 3C—3C in FIG. 2 respectively. In FIG. 3A, there are shown the face plate 11, the image-forming member 12 which is formed from a fluorescent film and a metal film (e.g., of aluminum) and also referred to as metal back and an anti-charge film 14 formed on the inner wall of the vacuum envelope.

If desired, the anti-charge film 14 is formed not only on the glass layer of the inner wall of the vacuum envelope but also on the image-forming member 12 and the electron source 2. An anti-charge film if arranged on the electron source 2 can also prevent charge-ups from taking place there and if arranged on the image-forming member reduce the reflection of electrons thereby.

As pointed out above, any leak currents that can appear among any of the electron-emitting devices and the wires of the electron source does not give rise to any problem so long as the sheet resistance of the anti-charge film is found between $10^8$ and $10^{10}\Omega/\square$.

The anti-charge film may be made of any material so long as it provides a desired sheet resistance and a sufficient degree of stability. For example, a film obtained by dispersing fine graphite particles to an appropriate density may be used. Since such a film can be made sufficiently thin, a thin film of fine graphite particles arranged on the metal back of the image-forming member does not show any harmful effect such as reducing the number of electrons striking the fluorescent bodies of the image-forming member to make them emit light. Additionally, since such a film is less apt to give rise to elastic scattering of electrons when compared with the material of the metal back which is typically aluminum, it can be effective to reduce the number of scattering electrons possibly causing charge-ups.

When an electric discharge occurs along the inner wall of the vacuum envelope with the above arrangement, the generated discharge current flows into the low resistance electric conductor 5 by way of the image-forming member 12 being applied with a high voltage and the inner wall of the vacuum envelope and then most of the current flows down to the ground through the low impedance ground connection line so that the possible flow of electricity into the electron source 2 through the wires 3-1 or further to the ground through the glass and other members of the vacuum envelope can be effectively avoided. Note that the ground connection line as used herein refers to the electric current flow path between the low resistance electric conductor 5 and ground.

In FIG. 3B, the ground connection terminal 505 is connected to the low resistance electric conductor 5 which is connected to the anti-charge film 14 and drawn out into the atmosphere. The ground connection terminal 505 may be connected to the low resistance electric conductor 5 by appropriate means such as laser welding, an electroconductive adhesive agent or metal bonding, although the use of solder of the type popularly used for bonding electric wires may be a reliable choice. The ground connection terminal 505 is a rod made of a highly conductive metal such as Ag or Cu and having a sufficiently large cross section (e.g., an Ag rod having a diameter of 2 mm or an electric resistivity as small as about 5 mΩ per centimeter or a Cu or Al rod having an electric resistance of about the same level) and coated with an Au coat layer arranged to reduce the contact resistance of the surface. Preferably, the abutting section of the low resistance electric conductor 5 is also coated with Au or made of Au to reduce the contact resistance between the ground terminal 505 and the low resistance electric conductor 5.

Then, the entire electric resistance of the current flow path from the low resistance electric conductor 5 down to the ground can be reduced to a level as low as less than 1 Ω by connecting the connector of the ground connection terminal 505 to the ground.

On the other hand, the coefficient of self-induction of the ground connection line can be reduced to less than $10^{-6}$H by reducing the distance between the ground connection terminal 505 and the ground. Thus, the impedance can also be reduced to less than about 10 Ω for the frequency component of 10 MHz. Then, the impedance for the frequency component of 1 GHz will be 1 kΩ at most.

Assume here that there is no ground connection line. Then, the electric current between the low resistance electric conductor 5 and the ground mainly flows through the surface of the rear plate (or the anti-charge film if it is arranged) and goes into the is electron source before it further flows down to the ground by way of the electron source drive wires. Referring to FIG. 14A, this flow path corresponds to those of the electric currents $i_3$ and $i_4$ and the dominant factor of the impedance of this flow path will be the resistance of the electric current flow path through the surface of the rear plate or the anti-charge film. If the electron source has a peripheral length of 100 cm and is separated from the low resistance electric conductor by lam and the anti-charge film has a sheet resistance of $10^8\Omega/\square$, the electric current will meet a resistance of about 1MΩ assuming that it flows evenly through the anti-charge film. This value is sufficiently large if compared with the impedance of the ground connection line.

The electric resistance of this part will be even greater if there is no anti-charge film.

If, on the other hand, the distance separating the electron source and the low resistance electric conductor is reduced to about 1 mm, then, the resistance of this part will be 1/10 of the above cited value. If the value is further reduced to a fraction of 1/10 of the above cited value, the electric resistance between the low resistance electric conductor and the electron source will be somewhere around 10 kΩ. This value, however, will be an extreme case and the actual value will be greater than this. The resistance of this part will dominate the impedance of the flow path of the electric current between the low resistance electric conductor and the ground when the ground connection line does not exist. Thus, the impedance Z' of the electric current flow path is substantially equal to the resistance (which will be indicated by R' hereinafter) of the entire flow path, of which the resistance between the low resistance electric conductor and the electron source takes a major part.

If a discharge current flows into the low resistance electric conductor, the ratio of the electric current that flows further from the low resistance electric conductor to the ground by way of the low imp-cane line to the electric current that flows from the low resistance electric conductor into the electron source by way of the anti-charge film and then down to the ground by way of the electron-emitting devices and the wires of the electron source is equal to the ratio of the reciprocal number of the impedance Z and that of the impedance Z'(=R'). If R' is ten times greater than Z, then the discharge current due to an electric discharge that flows down to the ground through the electron source will be a fraction of its counterpart when there is no low impedance line.

Of the impedance of the low impedance line, the self-induction component will be about 10 Ω for the frequency of 10 MHz and 1 kΩ for the frequency of 1 GHz. Therefore, if the resistance component (which will be indicated by R hereinafter) is less than 1 kΩ, the impedance Z will be 1 kΩ or less for a frequency range below 1 GHz or less than 1/10 of Z'(=R'). If R Is less than 100 Ω, then the impedance Z will be 100 Ω or less for a frequency range lower below 100 MHz.

It is not possible to define in simple terms the degree of reduction in the electric current flowing into the electron source that can save the electron-emitting devices, the vacuum envelope and the drive circuit from damages when an electric discharge occurs, because the degree can vary significantly depending on the various parameters of individual image-forming apparatus. However, it may be safe to assume that the discharge current that flows into the electron source will show a certain dispersion pattern in statistic terms and, as a rule of thumb, the probability of damaging the electron source can be significantly reduced by reducing the discharge current flowing into the electron source by one or two digits.

While R' is assumed to show a minimal value of 10 kΩ in the above description, a similar effect or an even greater effect can be expected when R' is greater than the above value and R is less than 1/10 or 1/100 of R'.

The line for the connection down to the ground may alternatively be drawn out from the back side of the rear plate in place of the above described techniques.

In FIG. 3C, reference numeral 16 denotes the high voltage terminal for feeding the image-forming member 12 with a high voltage (anode voltage Va). A hollow member 101 is placed with frit glass between the through hole 102 of the rear plate 1 and the face plate 11 carrying thereon the image-forming member 12 and baked to securely hold it in place. A drawn-out wire 100 is connected to the image-forming member 12 and drawn out from the inside of the vacuum envelope to the atmosphere. The high voltage terminal 16 is electrically connected to the drawn-out wire 100 which is connected to the image-forming member 12 arranged on the face plate 11 in the atmosphere after the vacuum envelope is prepared. The high voltage terminal may be made of an electrically highly conductive material such as Ag or Cu. Techniques that can be used for connecting the high voltage terminal 16 include laser welding, the use of an electroconductive adhesive agent and metal bonding.

The distance of the atmospheric gap between the high voltage terminal 16 and the hollow member 101 should be selected as a function of the voltage of the terminal because electric discharges likely occur more often when the voltage is high. If a sufficiently large distance cannot be secured for the gap, an insulating material for prevention of dielectric breakdown such as ceramic or teflon may be arranged around the terminal 16.

If such an insulator is used, electric discharges can occur along the lateral surface of the insulator. Therefore, it is preferable to arrange the low resistance electric conductor 5 around the through hole 102 as shown in FIG. 2 to prevent any discharge current from flowing into the electron source and the vacuum envelope.

Alternatively, the high voltage wiring may be drawn out to the side of the face plate.

The anti-charge film 14 is preferably formed not only on the inner wall surfaces of the face place, the support frame n the rear plate but also on the getter shield plate.

Electron-emitting devices of any type may be used for the electron source 2 of this mode of carrying out the invention so long an they are adapted to an image-forming apparatus in terms of electron-emitting performance and the size of the devices. Electron-emitting devices that can be used for the purpose of the invention include thermionic electron-emitting devices and cold cathode devices such as field emission devices, semiconductor electron-emitting devices, MIM type electron-emitting devices and surface conduction electron-emitting devices.

Figure 11A:
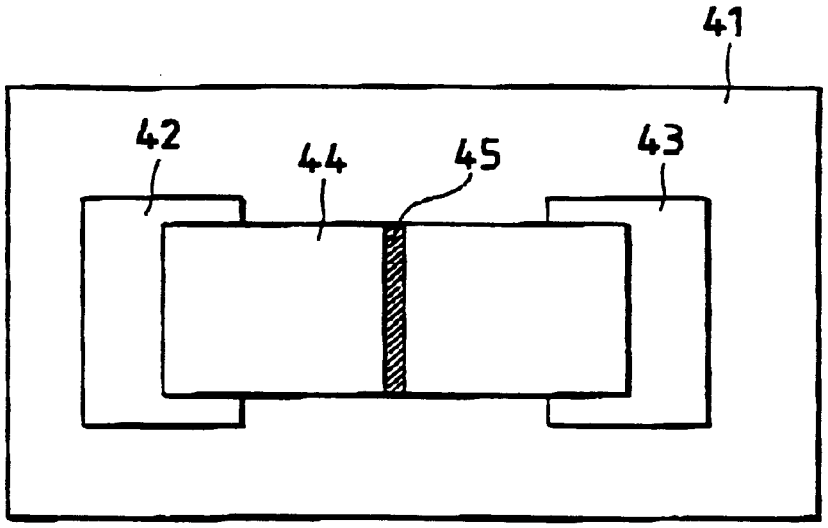
FIGS. 11A and 11B are a plan view and a cross sectional view schematically showing a surface conduction electron-emitting device that can be used for the purpose of the invention.
Figure 11B:
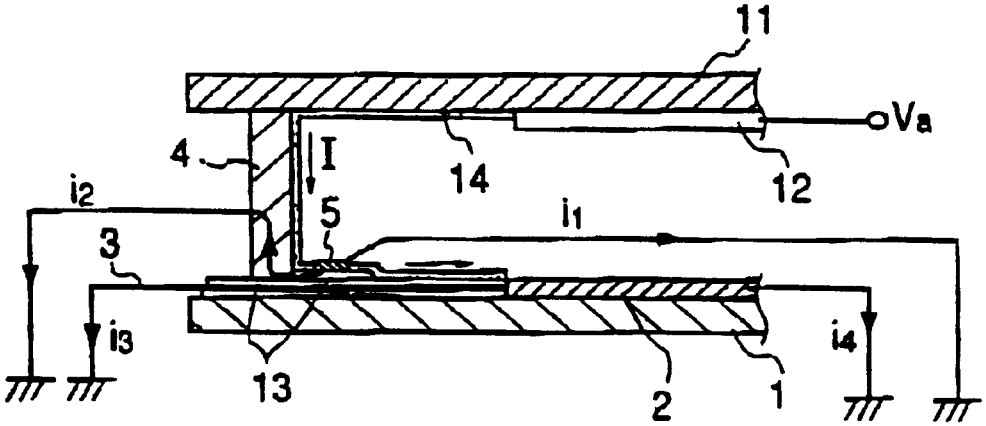

Surface conduction electron-emitting devices of the type as disclosed in Japanese Patent Application Laid-Open No. 7-235255 filed by the applicant of the present patent application are advantageously used in the following embodiments. FIGS. 11A and 11B schematically illustrates a surface conduction electron-emitting device disclosed in the above patent document. FIG. 11A is a plan view and FIG. 11B is a cross sectional view.

Referring to FIGS. 11A and 11D, the device comprises a substrate 41, a pair of device electrodes 42 and 43, an eleotroconductive film 44 connected to the device electrodes. An electron-emitting region 45 is formed in part of the eleotroconductive film. More specifically, the electron-emitting region 45 is an electrically highly resistive area produced. In the electroconductive film 44 by locally destroying, deforming or transforming the electroconductive film 44 to show a fissure there in a process referred to energization forming. Then, electrons will be emitted from the fissure and its vicinity.

Figure 6A:
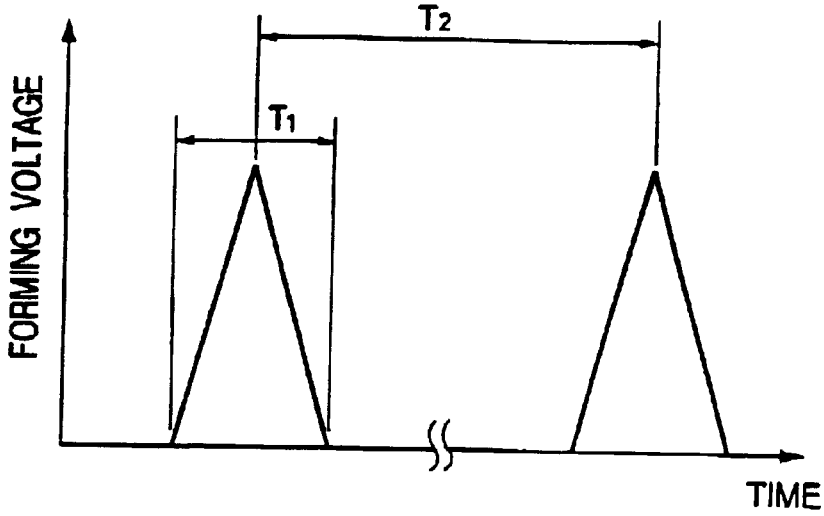
FIGS. 6A and 6B are graphs showing two alternative pulse voltages that can be used for forcing the electron-emitting region of a surface conduction electron-emitting device for the purpose of the invention.
Figure 6B:
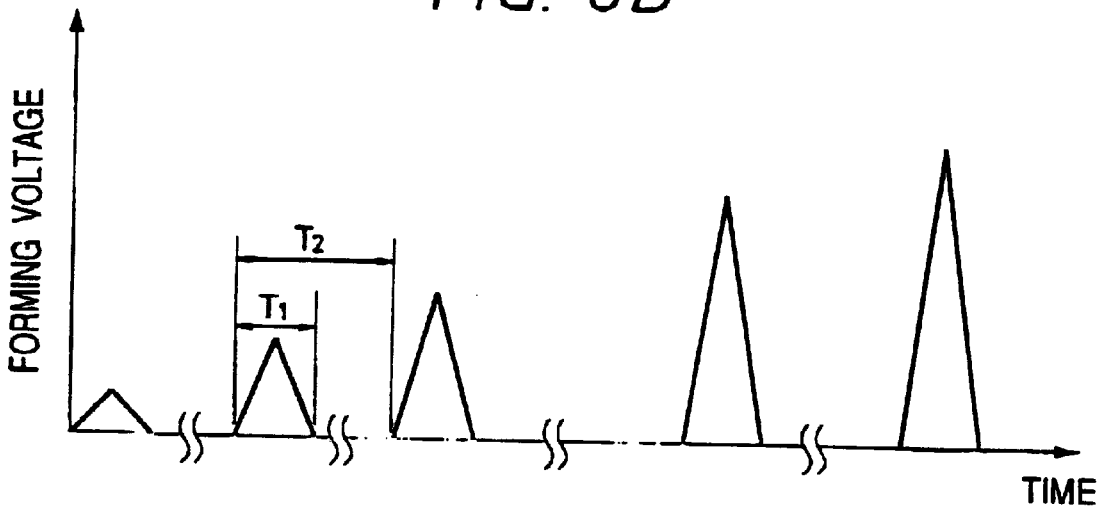

An energization forming process is a process where a voltage is applied between the pair of device electrodes 42 and 43. The voltage to be used for energization forming preferably has a pulse waveform. A pulse voltage having a constant height or a constant peak voltage may be applied continuously as shown in FIG. 6A or, alternatively, a pulse voltage having an increasing height or an increasing peak voltage may be applied as shown in FIG. 6B.

After the energization forming operation, the device is subjected to an "activation process". In an activation process, a pulse voltage may be repeatedly applied to the device in an atmosphere containing organic substances to deposit a substance containing carbon or a carbon compound as principle ingredient on and/or around the electron-emitting region. As a result of the activation process, both the electric current that flows between the device electrodes (device current If) and the electric current generated by electrons emitted from the electron-emitting region (emission current Ie) rises.

The electron-emitting device that has been treated in an energization forming process and an activation process is then preferably subjected to a stabilization process. This is a process for removing any organic substances remaining near the electron-emitting region in a vacuum chamber. The exhausting equipment to be used for this process preferably does not involve the use of oil so that it may not produce any evaporated oil that can adversely affect the performance of the treated device. Thus, the use of a sorption pump or an ion pump may be a preferable choice for the exhausting equipment.

The partial pressure of the organic gas in the vacuum chamber is such that no additional carbon or a carbon compound would not be deposited on the device and preferably lower than $1.3\times10^{-6}$Pa and more preferably lower than $1.3\times10^{-5}$Pa. The vacuum chamber is preferably evacuated after heating the entire chamber so that organic molecules adsorbed by the inner wall of the chamber or the electron-emitting device in the chamber may also be easily eliminated. While the vacuum chamber is preferably heated to 80° C. to 250° C., particularly higher than 150° C., for a period as long as possible, other heating conditions may alternatively be selected depending on the size and the profile of the vacuum chamber and the configuration of the electron-emitting device in the chamber as well as other considerations. The pressure in the vacuum chamber needs to be made as low as possible and is preferably lower than $1\times10^{-5}$Pa and more preferably lower than $1.3-10^{5}$Pa.

Preferably, the atmosphere after the completion of the stabilization process in maintained for driving the electron-emitting device, although a lower degree of vacuum may alternatively be used without damaging the stability of operation of the electron-omitting device or the electron source if the organic substances in the chamber are sufficiently removed.

By using such an atmosphere, the formation of any additional deposit of carbon or a carbon compound can be effectively suppressed and moisture or oxygen adsorbed by the vacuum chamber and the substrate can be eliminated to consequently stabilize the device current If and the emission current Ie.

Figure 12:
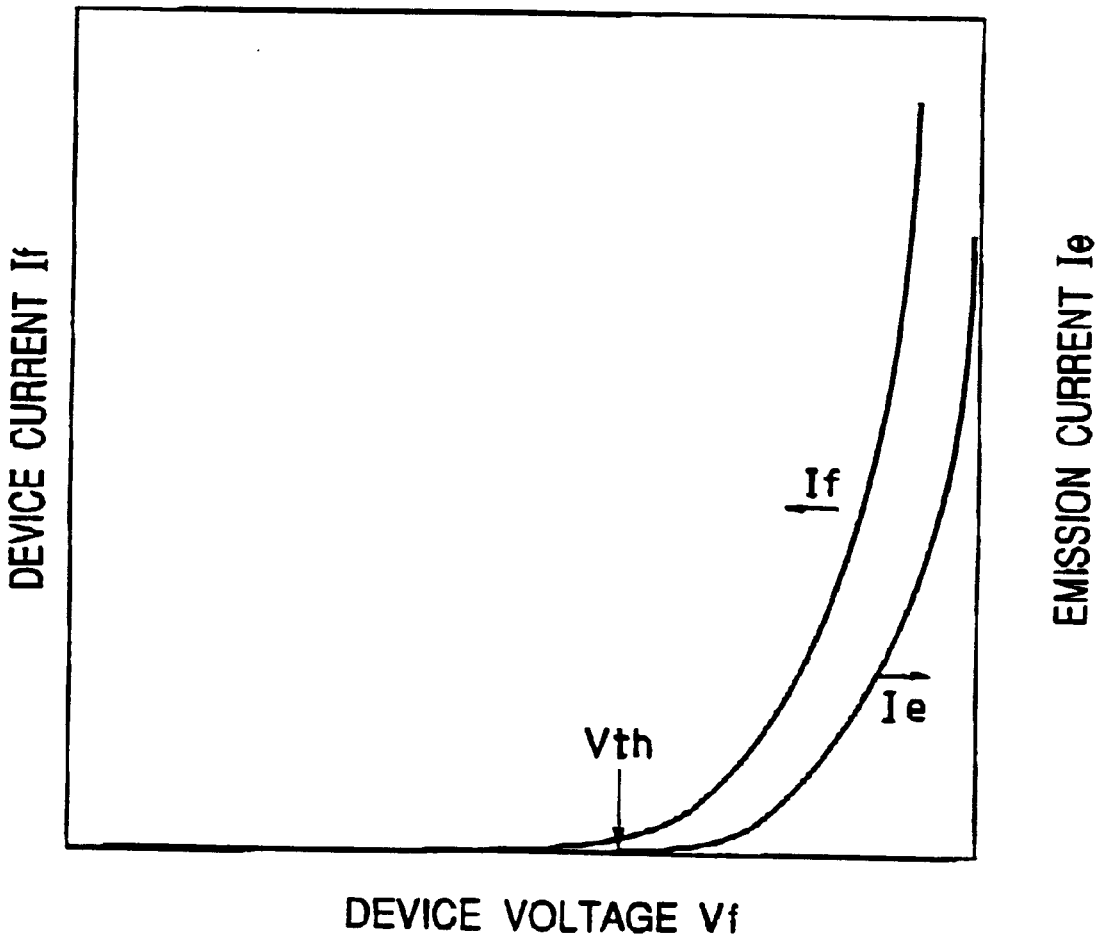
FIG. 12 is a graph showing typical electric characteristics of the surface conduction electron-emitting device of FIGS. 11A and 11B.

FIG. 12 shows a graph schematically illustrating the relationship between the device voltage Vf and the emission current Ie and the device current If of a surface conduction electron-emitting device prepared in a manner as described above. Note that different units are arbitrarily selected for Ie and If in FIG. 12 in view of the fact that Ie has a magnitude by far smaller than that of If. Also note that both the vertical and transversal axes of the graph represent a linear scale.

Referring to FIG. 12, the electron-emitting device shows a sudden and sharp increase in the emission current Ie when the device voltage Vf applied thereto exceeds a certain level (which is referred to as a threshold voltage hereinafter and indicated by Vth in FIG. 12), whereas the emission current Ie is practically undetectable when the applied voltage is found lower than the threshold value Vth. Differently stated, an electron-emitting device according to the invention is a non-linear device having a clear threshold voltage Vth relative to the emission current Ie. Thus, an image-for g apparatus can be realized by two-dimensionally arranging a number of electron-emitting devices with an image-forming member disposed vis-a-vis the devices and connecting the electron-emitting device with a matrix wiring system. Then, images can be formed by driving selected ones of the electron-emitting devices to emit electrons by means of a simple matrix drive arrangement and irradiating the image-forming member with electrons.

Figure 13A:
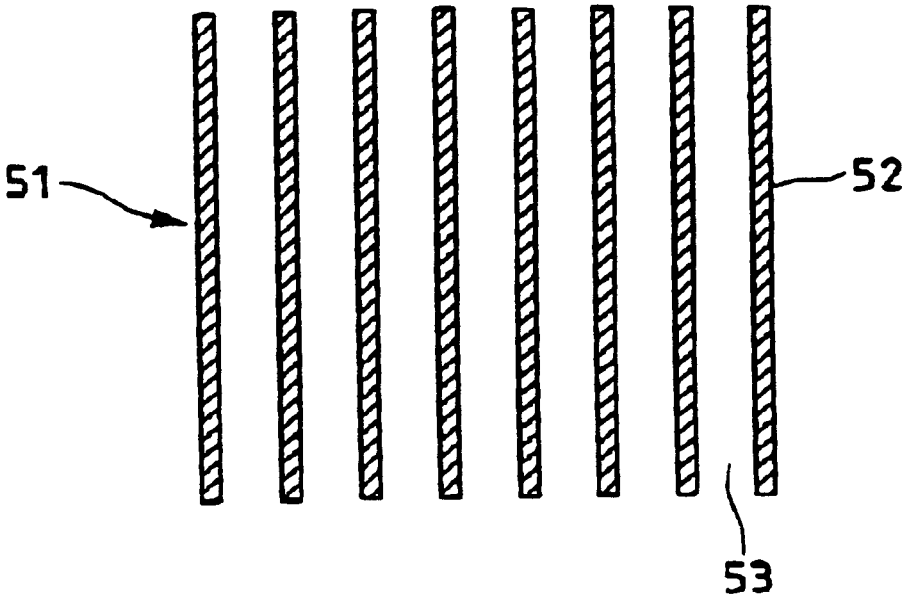
FIGS. 13A and 13B are two typical image-forming members that can be used for the purpose of the invention.
Figure 13B:
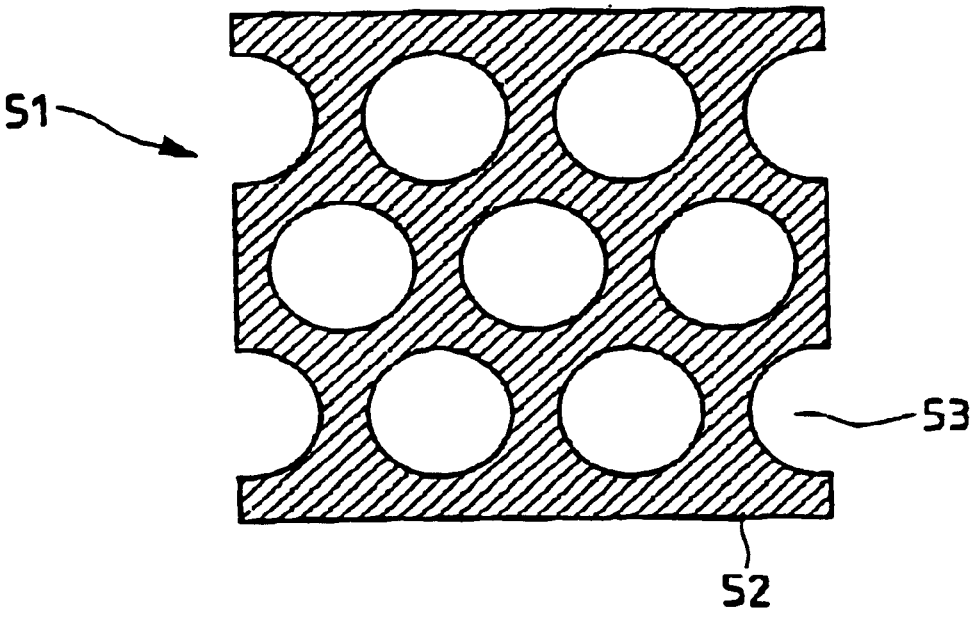

Now, the image-forming member comprising a fluorescent film will be described. FIGS. 13A and 13B schematically illustrate two possible arrangements of fluorescent film. While the fluorescent film 51 comprises only a single fluorescer if the display panel is used for displaying black and white pictures, it needs to comprise for displaying color pictures black conductive members 52 and fluorescers 53, of which the former are referred to as black stripes or a black matrix depending on the arrangement of the fluorescers. Black stripes or a black matrix are arranged for a color display panel so that color mixing of the fluorescers 53 of three different primary colors are made less discriminable and the adverse effect of reducing the contrast of displayed images of reflected external light is weakened by blackening the surrounding areas. While graphite is normally used as a principal ingredient of the black stripes, other conductive material having low light transmissivity and reflectivity may alternatively be used.

A precipitation or printing technique is suitably used for applying a fluorescent material on the face plate 11 regardless of black and white or color display. An ordinary metal back is arranged on the surface of the fluorescent film 51. The metal back is provided in order to enhance the luminance of the display panel by causing the rays of light emitted from the fluorescers and directed to the inside of the envelope to turn back toward the face plate 11, to use it as an electrode for applying an accelerating voltage to electron beams and to protect the fluorescent bodies against damages that may be caused when negative ions generated inside the envelope collide with them. It is prepared by smoothing the surface of the fluorescent film (in an operation normally called "filming") and forming an Al film thereon by vacuum evaporation after forming the fluorescent film.

A transparent electrode may be formed on outer surface of the fluorescent film 51 of the face plate in order to raise the conductivity of the fluorescent film Care should be taken to accurately align each of color fluorescent bodies and an electron-emitting device, if a color display is involved, before the above listed components of the envelope are bonded together.

Thus, it is now possible to supply thin flat type electron beam image-forming apparatus reliably and stably due to the arrangement of a hollow member at the high voltage drawing out section or the low resistance electric conductor drawing out section of the apparatus.

Now, the present invention will be described further by way of examples.

EXAMPLE 1

In this example, an electron source was prepared for an image-forming apparatus by arranging a plurality of surface conduction electron-emitting devices on the rear plate of the apparatus that was used as substrate and connecting them by means of a matrix wiring arrangement. The steps of manufacturing the apparatus will be described by referring to FIGS. 3A, 3B, 4A through 4E and 5.

(Step-a)

After thoroughly cleansing a soda lime glass plate, an $SiO_2$ film was formed thereon to a thickness of 0.5 $\mu$m by sputtering to produce a rear plate 1. Then, a circular through hole 102 (FIG. 5) having a diameter of 4 mm for introducing a high voltage terminal 16 (FIG. 3C) and an exhaust hole 501 (FIG. 5) were bored through the rear plate 1 by means of an ultrasonic boring machine.

Figure 4A:
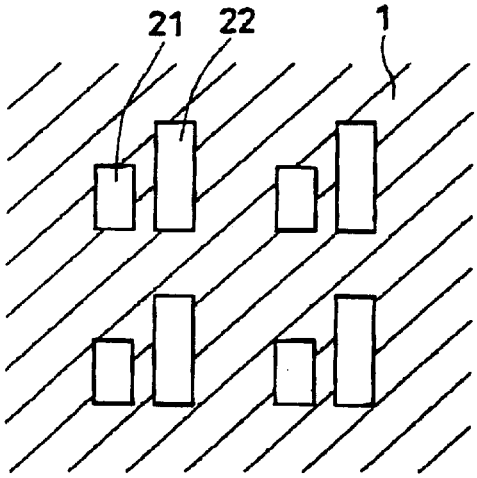
FIGS. 4A, 4B, 4C, 4D and 4E are schematic partial plan views of an image-forming apparatus according to the invention in different manufacturing steps.

Then, a Ti film and an Ni film were sequentially formed to respective thicknesses of 5 nm and 100 nm on the rear plate by sputtering and then a pair of device electrodes for each electron-emitting device were produced by photolithography. The device electrodes were separated by 2 μm from each other (FIG. 4A).

(Step-b)

Figure 4B:
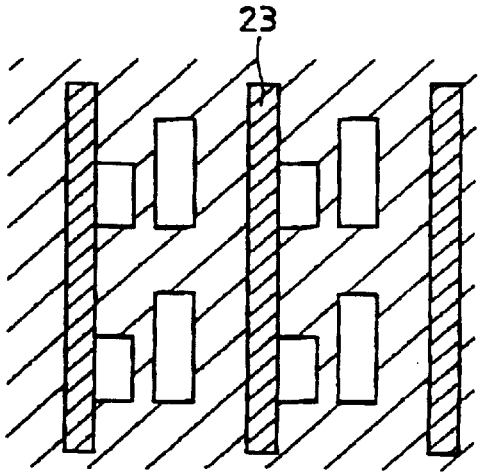
Figure 5:
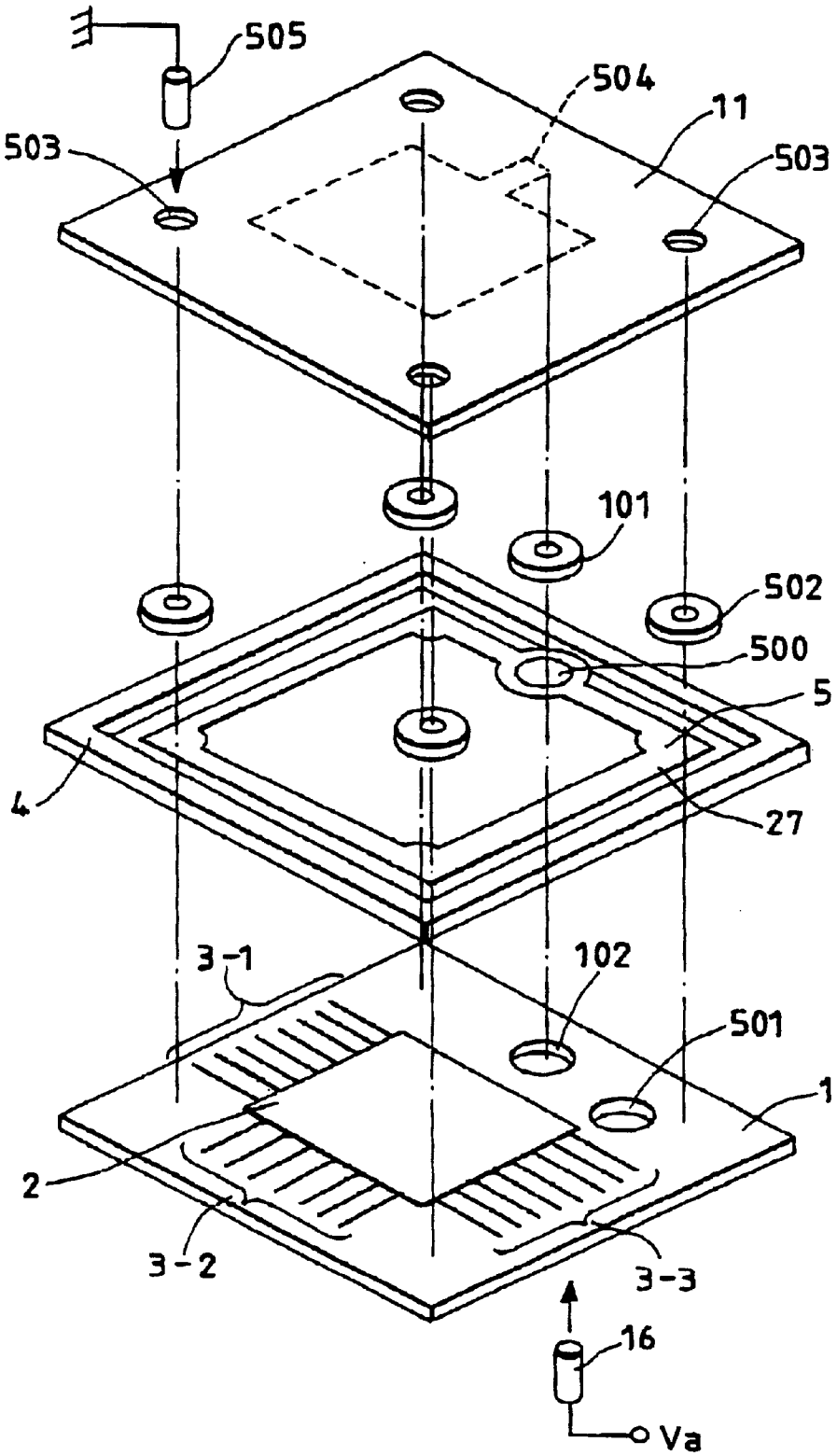
FIG. 5 is an exploded schematic perspective view of an image-forming apparatus according to the invention, illustrating how it is assembled.

Subsequently, Ag paste was applied to the rear plate to form a predetermined pattern by printing and then biked to produce Y-directional wires 23, which were extended to the outside of the electron source forming region to be electron source drive wires 3-2 (FIG. 5). Each of the wires was 100 μm wide and about 10 μm thick (FIG. 4B).

(Step-c)

Figure 4C:
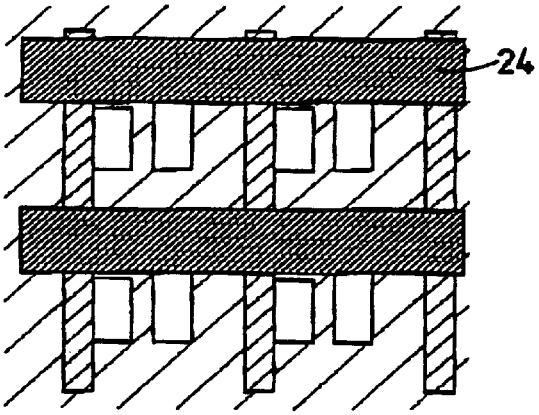
Figure 4D:
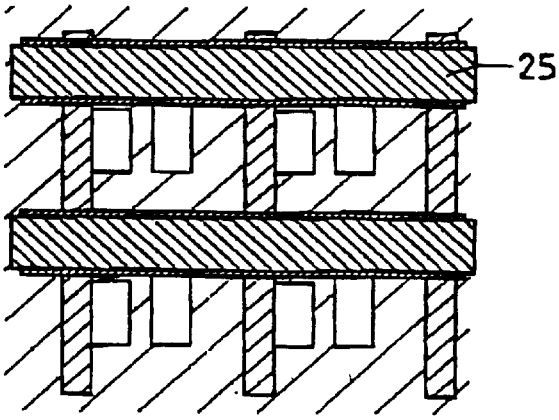

Then, paste containing PbO as the principal ingredient mixed with glass binder was applied thereon by printing to produce an about 20 μm thick insulation layer 24 for insulating the Y-directional wires from X-directional wires, which will be described below. In the insulation layer 24, a cut-out area was provided for each device electrode 22 of each electron-emitting device to allow the device electrodes to be connected to the corresponding X-directional wire (FIG. 4C)

(Step-d)

Thereafter, X-directional wires 25 were formed on the insulation layer 24 (FIG. 4D) in a manner as described above for the Y-directional wires 23. Each is of the wires was 300 μm wide and about 10 μm thick. Subsequently, an electroconductive film 26 of fine PdO particles was formed for each device.

More specifically, the eleotroconductive film 26 was produced as follows. A Cr film was formed on the substrate 1 carrying thereon the wires 23 and 25 by sputtering and then an opening having a contour corresponding to that of the electroconductive film 26 was formed through the Cr film for each device by photolithography.

Figure 4E:
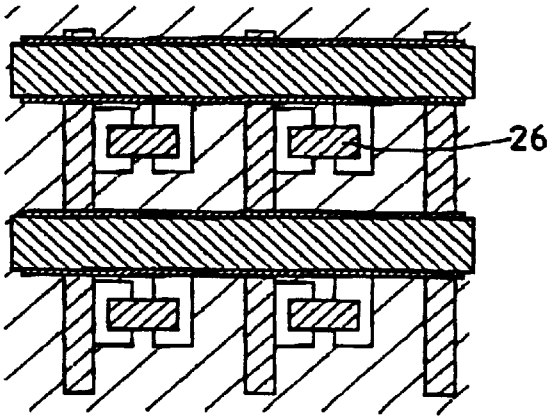

Thereafter, a solution of an organic Pd compound (ccp-4230: available from Okuno Pharmaoeutical Co., Ltd) was applied to the Cr film and baked at 300° C. for 12 minutes in the atmosphere to produce a film of fine PdO particles. Then the Cr film was removed by wet etching and the fine PdO particle film was lifted off to produce the electroconductive film 26 having the predetermined contour (FIG. 4E).

(Step-e)

Once again, paste containing PbO as the principal ingredient mixed with glass binder was applied to the rear plate in the area other than those of the device 23 and the electroconductive films 26 (electron source region 2 in FIG. 2), which corresponds to the inside of the support frame 4 in FIG. 2.

(Step-f)

In Step f, a quartz glass frame 27 having a configuration as shown in FIG. 5 was arranged on the rear plate 1. The quartz glass frame 27 was 0.5 mm thick and had a circular area of 8 mm diameter provided with a through hole 500 with a diameter of 8 mm at the center thereof for introducing the high voltage feed-in terminal therethrough.

Then, a low resistance electric conductor 5 having a width slightly smaller than that of the quartz glass frame 27 was formed on the quartz glass frame 27 by printing. The low resistance electric conductor was made of Au. It was 2 mm wide and about 100 μm thick. Subsequently, the quartz glass plate was then placed on the rear plate with the through holes 102 and 500 aligned with each other and the glass paste was heat treated to produce the insulation layer and, at the same time, to secure the quartz glass frame 27 carrying thereon the low resistance electric conductor 5 to the proper position.

The quartz glass frame 27 was used for the frame in order to provide a sufficient dielectric withstand pressure between the low resistance electric conductor 5 and the electron source drive wires 3-1, 3-2 and 3-3. Therefore, if it is possible to provide a sufficient dielectric withstand pressure by means of glass paste, the insulation layer may be made of glass paste and a low resistance electric conductor 5 may be provided directly thereon.

(Step-g)

A support frame 4, an opening forming ring member 101 for the high voltage terminal and four ring members 502 for connecting the ground lines were bonded to the rear plate 1 by means of frit glass. The frit glass was LS3081 (tradename) available from Japan Electric Glass and biked provisionally at 380° C. and then properly at 410° C. Then, the opening forming ring member 101 for the high voltage terminal and the ring members 502 for connecting the ground line were centered at the respective terminal positions and securely held there. More specifically, the ring member 101 was aligned with the through hole 102 of the rear plate 1 for connecting the high voltage terminal and the ring members 502 were aligned with the through holes 503 of the face plate 11 for connecting the ground lines.

At the same time, a getter 8 was rigidly secured to its proper position by means of frit glass (not shown). The getter was Ring Type Getter N-301 (tradename) available from Toshiba Corporation. Then, an anti-discharge film 14 was formed to show a sheet resistance of about $10^8\Omega/\square$ by spray-coating a disperse solution of fine carbon particles onto the areas that make the inner surface of the vacuum envelope and then drying the solution.

(Step-h)

Then, a face plate was prepared by using a substrate of soda lime glass having an $SiO_2$ layer as in the case of the rear plate. An opening 503 for a ground connection terminal lead-in port was formed by ultrasonic cutting. Thereafter, high voltage lead-in terminal abutting drawn-out wire 504 and wires for connecting it to the metal back were formed with Au by printing and then black stripes and stripe-shaped fluorescent bodies were formed for the fluorescent film and subjected to a filming operation. Then, an Al film was formed thereon to a thickness of about 20 μm by vacuum evaporation to produce a metal back.

Subsequently, an anti-charge film 14 was formed by spray-coating a disperse solution of fine carbon particles onto the areas to be the inner surface of the vacuum envelope and then drying the solution. Of the produced film, the areas formed on the metal back has the effect of suppressing reflection of incident electron beams and hence preventing charge-ups from taking place due to reflected electrons that collide with the inner wall of the vacuum envelope.

(Step-i)

The support frame 4 bonded to the rear plate was then bonded to the face plate by means of frit glans, The frit glass was LS3081 (tradename) available from Japan Electric Glass and baked provisionally at 380° C. and then properly at 410° C.

Note that the electron-emitting devices of the electron source and the fluorescent film of the face plate were carefully aligned for positional correspondence.

(Step-j)

The prepared image-forming apparatus was then connected to a vacuuming/exhausting equipment by way of an exhaust pipe to evacuate the inside of the envelope to a pressure level of less than $10^{-4}$ Pa, when an energization forming process was started.

The energization forming process was conducted by applying a pulse voltage with a peak value gradually increasing with time as schematically illustrated in FIG. 6B to the electron-emitting devices row by row along the X-direction. The pulse width and the pulse interval were T=1 msec and T2=10 msec respectively. During the energization forming process, an extra rectangular pulse voltage of 0.1 V (not shown) was inserted into intervals of the forming pulse voltage in order to determine the resistance of the electron emitting region and the energization forming operation was terminated for a row when the resistance of each device exceeded 1M. In this way, an energization forming operation was performed for all the rows to complete the process.

(Step-k)

Subsequently, the electron source was subjected to an activation process. Prior to this process, the inside of the vacuum envelope was further evacuated to a pressure level of less than $10^{-5}$ Pa by means of an ion pump, keeping the image-forming apparatus to 200° C. Subsequently, acetone was introduced into the vacuum envelope until the internal pressure rose to $1.3\times10^{-2}$ Pa Then, a rectangular pulse voltage with a height of 16 V and a width of 100 $\mu$sec was applied to the X-directional wires sequentially and cyclically one by one at pulse intervals of 125 $\mu$sec. Thus, a pulse voltage was applied to each of the X-directional wires with a pitch of 10 msec. As a result of this process, a film containing carbon as principal ingredient was deposited on and around the electron-emitting region of each electron-emitting device to raise the device current If.

(Step-l)

Thereafter, a stabilization process was carried out. The inside of the vacuum envelope was evacuated once again by means of an ion pump for 10 hours, maintaining the image-forming apparatus to 200° C. This step was for removing molecules of organic substances remaining in the vacuum envelope to prevent any further growth of the deposited film containing carbon as a principal ingredient to stabilize the performance of each electron-emitting device (Step-m)

After cooling the image-forming apparatus to room temperature, the ground connection terminal was connected to the ground and a pulse voltage was applied to the X-directional wires as in Step-k and additionally a voltage of 5 kV was applied to the image-forming m by way of the high voltage lead-in terminal to make the fluorescent film emit light. The application of the respective voltages to the X-directional wires and to the image-forming member was terminated after visually confirming that the fluorescent film was emitting light uniformly without any areas that were not emitting light or appeared very dark. Then, the exhaust pipe was hermetically sealed by heating and melting it. Thereafter, the image-forming apparatus was subjected to a getter process using high frequency heating to complete the entire steps of preparing the vacuum envelope.

(Step-n)

In this step, the high voltage terminal 16, the ground line connection terminal 505 and the wire for driving the electron source were fitted to the completely prepared vacuum envelope. Indium solder was used to connect the high voltage terminal 16 to the drawn-out wire 504 connected to the image-forming member 12 by way of the through hole 102 of the rear plate 1. Thus, the high voltage terminal 16 was electrically connected to the image-forming member 12 and, at the same time, the vacuum envelope was mechanically secured.

The solder used for connecting the high voltage terminal was also used to connect the ground line connection terminal 505 to the low resistance electric conductor 5 formed on the quartz glass frame 27 by way of the through hole 503 of the face plate 11.

Subsequently, the electron source driving wires 3-1, 3-2 and 3-3 were connected to the electron source driving IC by way of a flexible cable (not shown)

Thus, the fluorescers of the image-forming member 12 arranged on the face plate 11 could be driven to emit light and display desired TV images.

When a high voltage of 6 kV was applied to the finished image-forming apparatus to make the fluoreocers emit light and display images, the apparatus operated stably for a prolonged period of time without destructing any element by electric discharges.

An image-forming apparatus prepared in this example provided the following advantages.

(1) The opening (recess) operating as terminal connecting section was recessed into the apparatus so that the connecting section did not protrude from the vacuum envelope. Thus, this arrangement is particularly suited for a thin image-forming apparatus (2) Since the related terminals can be connected after preparing the vacuum envelope, any popular connecting technique can be used.

(3) Therefore, the image-forming apparatus can be prepared an a stable and reliable basis at high yield.

EXAMPLE 2

Figure 7A:
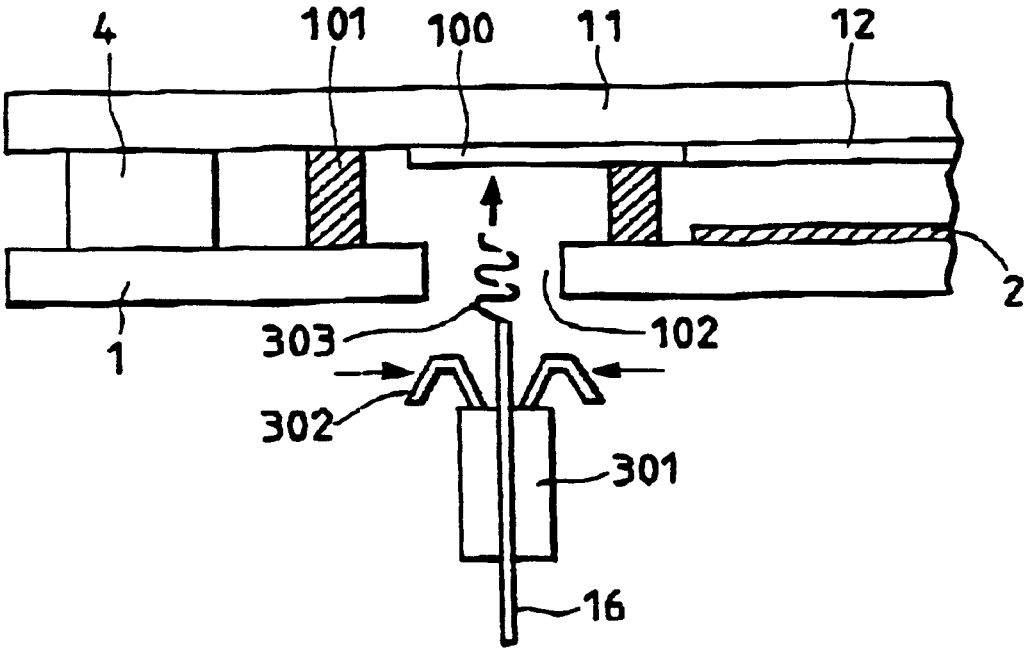
FIGS. 7A and 7B are schematic cross sectional views of an embodiment of the invention.
Figure 7B:
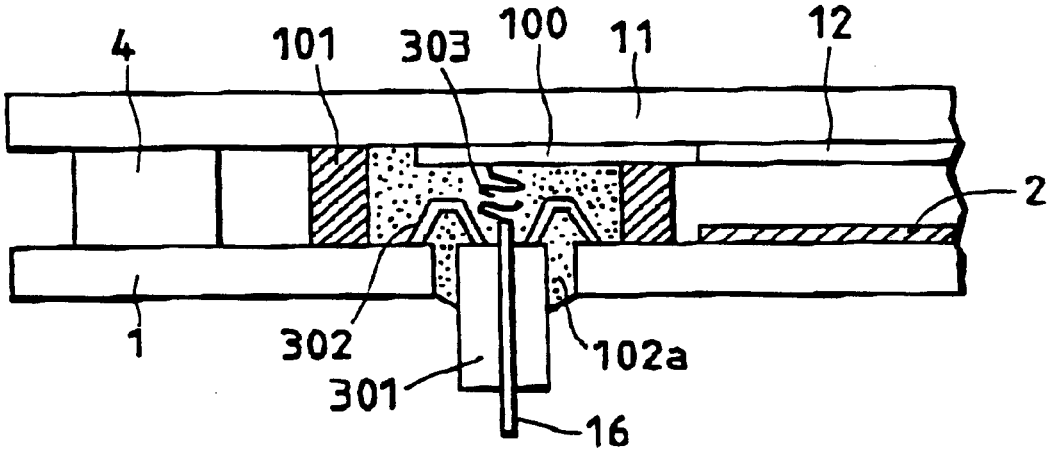

In this example, the wires drawn out from the inside of the vacuum envelope and the connection terminal external to the vacuum envelope were resiliently held in contact within the hollow member. Referring to FIGS. 7A and 7B, reference numeral 301 denotes an anchor block for securely holding the terminal 16 and a bifurcated spring 302 and reference numeral 303 denotes a connector spring for electrically connecting the wire 100 and the terminal 16. The anchor block 301 was inserted into the through hole 102 to be in a state illustrated in FIG. 7B from the state as shown in FIG. 7A. The anchor block 301 was prevented from coming off from the vacuum envelope by the spring 302. Under this condition, the connector spring 303 and a drawn-out wire (a feed-in electrode) 109 connected to the image forming member 12 are resiliently connected to each other.

Then, the gap between the through hole 102 and the anchor block 301 was filled with an insulating material of silicone resin in order to prevent moisture from adhering to the contact point of the drawn-out wire and the connection terminal and the surface of the hollow member 101 and other surfaces that were exposed to the atmosphere to give rise to electric discharges. However, the use of such an insulating material may not be necessary when the vacuum envelope is fed with a relatively low voltage.

With the above arrangement, the connection terminal connected to the wire can be disconnected to increase the applicability of the apparatus. For instance, they may be temporarily connected with each other to evaluate the quality of displayed images in the course of manufacturing.

EXAMPLE 3

Figure 8A:
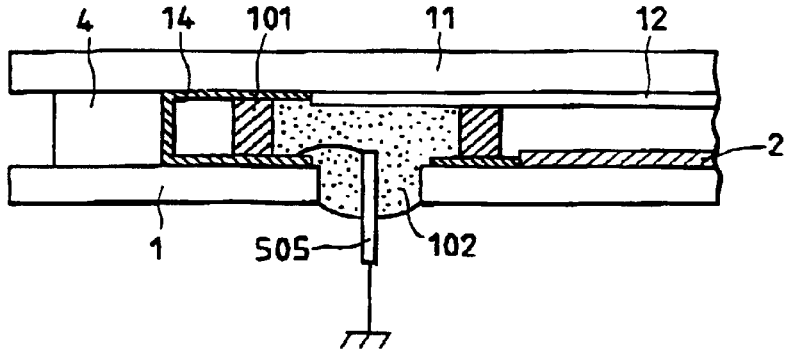
FIGS. 8A and 8B are schematic cross sectional views of another embodiment of the invention.
Figure 8B:
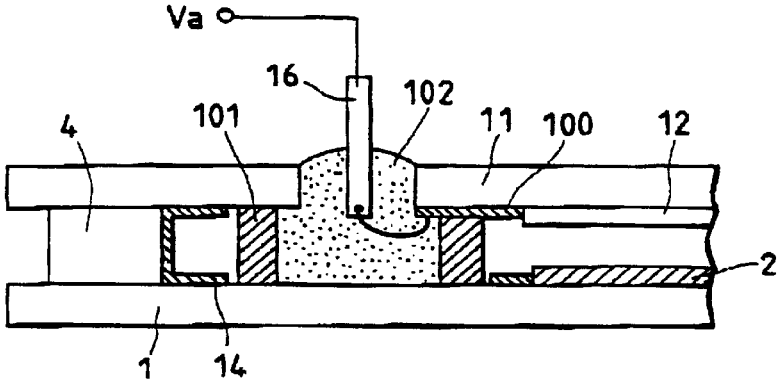

While in Example 1 the ground line connection terminal 505 and the high voltage terminal 16 were introduced into the vacuum envelope from the face plate 11 and from the rear plate 1 respectively, they may alternatively be arranged the other way, i.e., the ground line connection terminal 505 from the rear plate 1 and the high voltage terminal 16 from the face plate 11 to achieve an effect substantially the same as Example 1. FIGS. 8A and 8B schematically illustrate this arrangement.

EXAMPLE 4

Figure 9:
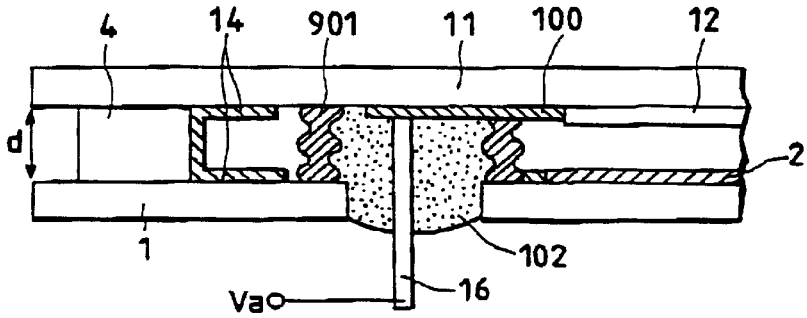
FIG. 9 is a schematic cross sectional view of still another embodiment of the invention.

This example will be described by referring to FIG. 9. In FIG. 9, reference symbol d denotes the distance separating the face plate 11 and the rear plate 1. When the distance is reduced to less than its counterpart in Example 1, the ring-shaped member also has a reduced creeping distance, which by turn may reduce the withstand voltage of the ring-shaped mater. To prevent it, the ring-shaped member was cut partly on the outer and inner peripheral surfaces to produce undulation shape 901 spanning the oppositely disposed surfaces of the rear plate 1 and the face plate 11. As a result, the apparatus operated stably as in Example 1 without giving rise to any electric discharges when subjected to a high voltage used in Example 1.

EXAMPLE 5

Figure 10:
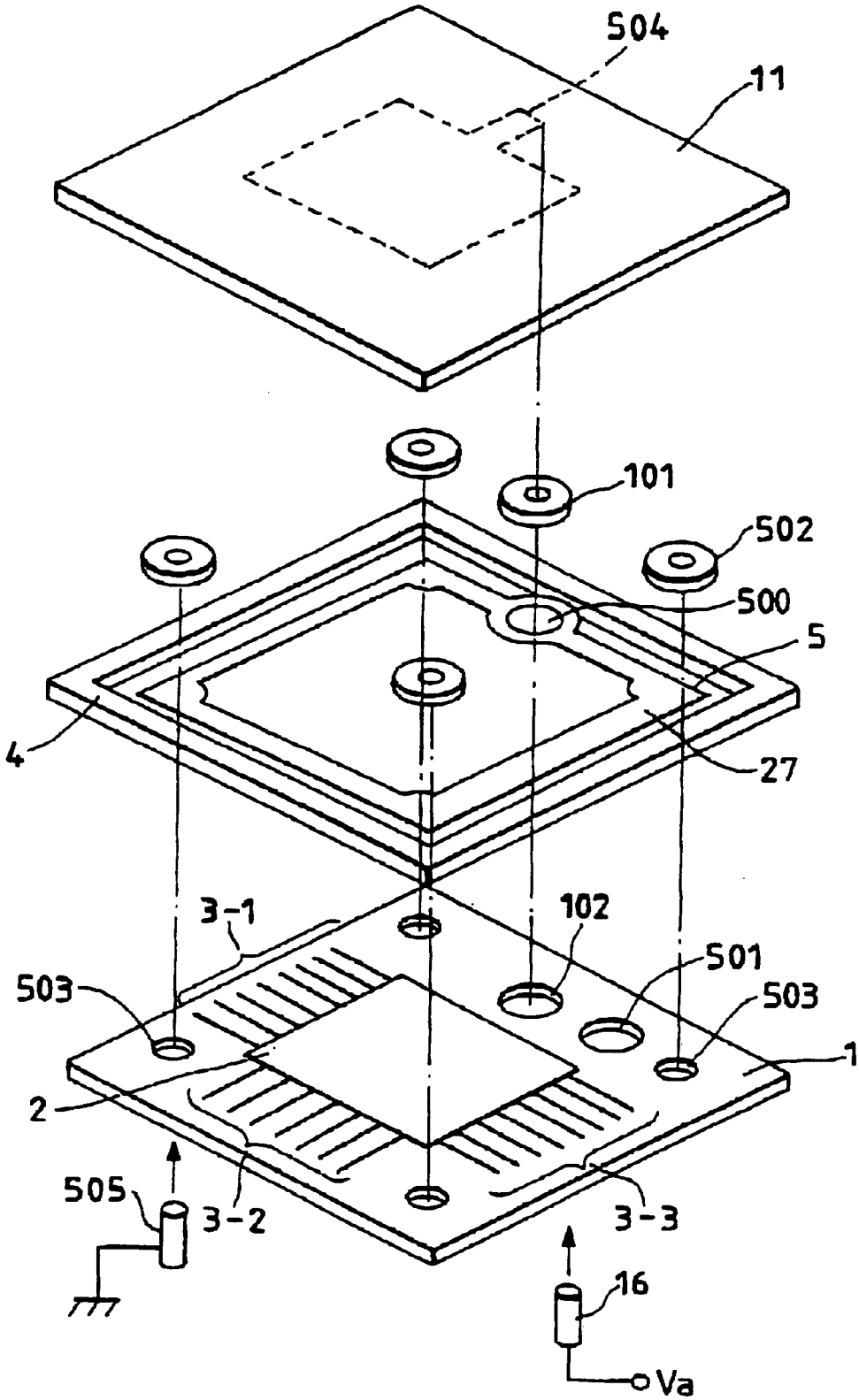
FIG. 10 is an exploded schematic perspective view of still another embodiment of the invention.

Both the high voltage terminal 16 and the ground line connection terminal 505 may be drawn out to the side of the rear plate 1, using the arrangement of FIG. 3C (Example 1) for the high voltage terminal 16 and that of FIG. 8A (Example 3) for the ground line connection terminal 505. FIG. 10 schematically illustrates the image-forming apparatus of this example obtained by arranging them in the above described manner. Note that the apparatus of this example differs from that of Example 1 except that the ground line connection terminal 505 was arranged at the side of the rear plate 1.

With this arrangement, both the ground line connection terminal 505 through which a large electric current can flow and the high voltage terminal 16 that should be subjected to a high voltage are drawn out from the rear side of the image-forming apparatus, suitable in taking safe measures for preventing the user from touching. It also provides an additional advantage that the through holes 102, 501 and 503 are bored through the rear plate 1 and no boring operation is required on the side of the face plate 11 to reduce the manufacturing cost.

EXAMPLE 6

Figure 16A:
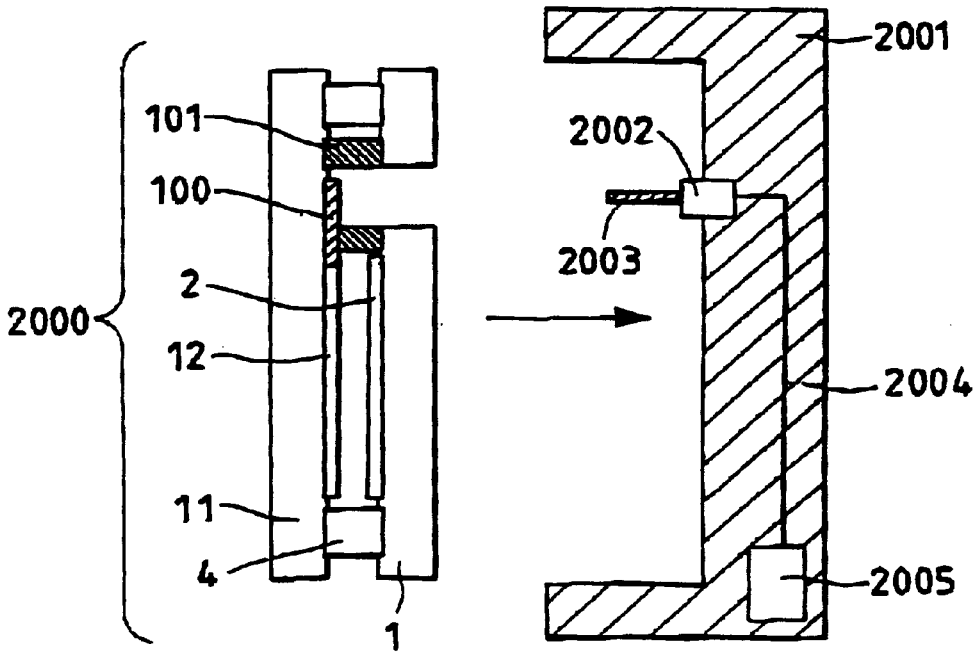
FIGS. 16A and 16B are partial cross sectional views schematically showing another embodiment of an image-forming apparatus according to the invention.
Figure 16B:
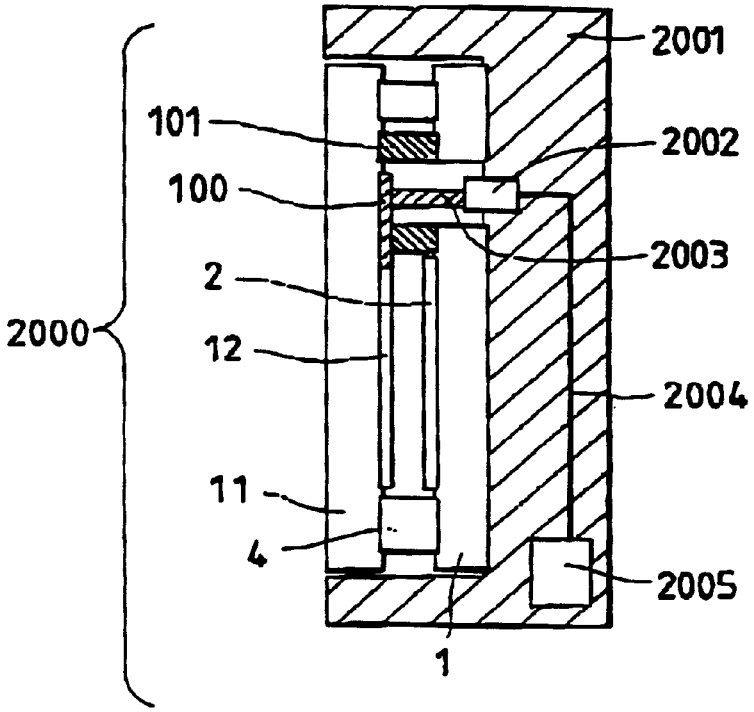

In this example, the high voltage terminal was held to the cabinet of the image-forming apparatus. Referring to FIG. 16A, showing the arrangement of an image-forming apparatus 2000 in cross section through the hollow member 101 for drawing in the high voltage member, which arrangement is the same as its counterpart of Example 1 and hence will not be described any further. In FIG. 16A. reference numeral 2001 denotes a cabinet made of engineering plastic and an aluminum member and operating as s support structure for the image-forming apparatus 2000. Reference numerals 2003 and 2002 respectively denote the high voltage terminal for supplying a high voltage to the drawn-out wire 100 and an insulating member for electrically insulating the high voltage terminal and the cabinet 2001, whereas reference numerals 2004 and 2005 respectively denote a cable wire and a high voltage source. The image-forming apparatus 2000 and the cabinet 2001 in the separate state as shown in FIG. 16A were put together as in FIG. 16B. The depth of the cabinet 2001 and the length of the high voltage terminal 2003 were regulated in advance such that they were electrically connected to the drawn-out wire 100 when the cabinet 2001 and the image-forming apparatus 2000 were put together. While there members may be electrically linked by regulating the projecting length of the high voltage terminal 2003, the high voltage terminal 2003 and/or the cabinet 2001 may be provided with resilience to establish a reliable electric connection between them. With this arrangement, a high voltage can be fed to the image-forming member 12 from the high voltage source 2005 by way of the cable wire 2004 and the high voltage terminal 2003 to drive the electron source by way of a drive circuit (not shown) and make the image-forming member 12 emit light.

The use of a high voltage terminal held by a cabinet as in this example provides the following advantages.

(1) Once the cabinet and the image-forming apparatus are put together, the high voltage terminal does not show any projection in the subsequent assembling steps to ensure an easy handling to make the manufacturing process more flexible and improve the manufacturing yield of the line.

(2) Since the high voltage terminal is fitted in position prior to the process of manufacturing the image-forming apparatus, the overall manufacturing time can be reduced.

While the present invention is described in terms of the use of surface conduction electron-emitting devices for the electron source, the present invention is not limited thereto by any means and the surface conduction electron-emitting devices may be replaced by field emission type electron-emitting devices, semiconductor electron-emitting devices or electron-emitting devices of some other type.

Furthermore, while the rear plate of the image-forming apparatus serves as the substrate of the electron source in any of the above examples, they might alternatively be prepared separately so that the substrate could be secured to the rear plate after preparing the electron source.

Additionally, any of the members of the image-forming apparatus in the above examples can be modified without departing from the technological scope of the invention.

As described above, an image-forming apparatus according to the present invention provides the following advantages.

Since the related terminals can be connected after preparing the vacuum envelope, any popular connecting technique can be used.

Therefore, the image-forming apparatus can be prepared on a stable and reliable basis at high yield.

The opening (recess) operating as terminal connecting section is recessed toward the inside of the apparatus so that the connecting section does not protrude from the vacuum envelope. Thus, this arrangement is particularly suited for a thin image-forming apparatus.

Thus, according to the invention, highly reliable flat type image-forming apparatus can be supplied on a stable basis.

Additionally, when a resilient member is used to connect the external terminal and the external wire, they can be removed after being placed in position to that any popular connecting technique can be used for them. For instance, they may be temporarily connected with each other to evaluate the quality of displayed images in the course of manufacturing.

When the peripheral surfaces of the ring-shaped hollow member are provided with undulations, it can be provided with a long creeping distance which by turn can increase the withstand voltage of the ring-shaped member. As a result, the apparatus operates stably without giving rise to any electric discharges when subjected to a high voltage.

Finally, the apparatus can withstand electric discharges when a low resistance electric conductor is arranged to surround the electron source and connected to the ground. devices .

What is claimed is:

1. An image-forming apparatus comprising:

an envelope; and image-forming means disposed within said envelope, wherein said envelope has a recess on an outer wall thereof and a feed-in electrode is arranged in the recess and electrically connected to said image-forming means, and wherein a vacuum is maintained within said envelope by said outer wall.

2. An image-forming apparatus according to claim 1, further comprising a conductor terminal connected to said feed-in electrode.

3. An image-forming apparatus according to claim 2, wherein said feed-in electrode and said conductor terminal are connected to each other by way of an electroconductive resilient body.

4. An image-forming apparatus according to claim 1, wherein said image-forming means includes an electron source and an image-forming member for forming an image when irradiated with electrons emitted from said electron source.

5. An image-forming apparatus according to claim 4, wherein the recess is formed by an opening arranged in either a first substrate carrying said electron source or a second substrate disposed opposite to said first substrate and carrying said image-forming member, a lateral member of the opening and said first substrate.

6. An image-forming apparatus according to claim 4, wherein the recess is formed by an opening arranged in a substrate carrying said electron source, a lateral member of the opening and a second substrate disposed opposite to said first substrate and carrying said image-forming member.

7. An image-forming apparatus according to claim 4, wherein said feed-in electrode is connected to an electrode for applying a voltage to said image-forming member.

8. An image-forming apparatus according to claim 7, wherein said feed-in electrode is connected to a conductor terminal.

9. An image-forming apparatus according to claim 4, further comprising an electroconductrve member on an inner wall surface of said envelope between said electron source and said image-forming member and an electric current flow path A connecting said electroconductive member to ground without passing through any of said electron source and a drive circuit of said electron source, wherein the electric resistance of said electric current flow path A is lower than the electric resistance of any electric current flow path B connecting said electroconductive member to the ground by way of at least one of said electron source and said drive circuit.

10. An image-forming apparatus according to claim 9, wherein said envelope has a second recess on said outer wall thereof and part of said electroconductive member is drawn to the second recess.

11. An image-forming apparatus according to claim 10, wherein the second recess is formed by an opening arranged in either a first substrate carrying said electron source or a second substrate disposed opposite to said first substrate and carrying said image-forming member, a lateral member of the opening and said first substrate.

12. An image-forming apparatus according to claim 9, wherein said electroconductive member is arranged to entirely surround said electron source.

13. An image-forming apparatus according to claim 9, wherein said envelope has an anti-charge film arranged on an inner wall surface thereof.

14. An image-forming apparatus according to claim 13, wherein said anti-charge film is electrically connected to said electroconductive member.

15. An image-forming apparatus according to claim 9, wherein said envelope has an electroconductive film having a sheet resistance between $10^8\Omega/\square$ and $10^{10}\Omega/\square$ arranged on an inner wall surface thereof.

16. An image-forming apparatus according to claim 15, wherein said electroconductive film is electrically connected to said electroconductive member.

17. An image-forming apparatus according to claim 10, wherein the second recess is formed by an opening arranged in a first substrate carrying said electron source, a lateral member of the opening and a second substrate disposed opposite to said first substrate and carrying said image-forming member.

18. An image-forming apparatus according to claim 10, wherein said electroconductive member drawn out into the recess is connected to a conductor terminal.

19. An image-forming apparatus according to claim 4, wherein said image-forming member includes fluorescers and an electrode.

20. An image-forming apparatus according to claim 4, wherein said image-forming member includes fluorescers and a metal back.

21. An image-forming apparatus according to claim 4, wherein said electron source includes a plurality of electron-emitting devices connected by wires.

22. An image-forming apparatus according to claim 4, wherein said electron source includes a plurality of electron-emitting devices connected by means of a matrix wiring arrangement using a plurality of row-directional wires and a plurality of column-directional wires.

23. An image-forming apparatus according to claim 21 or 22, where in said electron-emitting devices are cold cathode type electron-emitting devices.

24. An image-forming apparatus according to claim 23, wherein said cold cathode type electron-emitting devices are surface conduction electron-emitting devices.

25. An image-forming apparatus according to claim 1, wherein an insulating member is filled in the recess.

26. An image-forming apparatus comprising:

an envelope;

image forming means disposed within said envelope, wherein said envelope has a recess on an outer wall thereof and a feed-in electrode is arranged in the recess and electrically connected to said image-forming means;

a cabinet for holding said envelope and said feed-in electrode; and a conductor terminal arranged on a cabinet side and connected to said feed-in electrode.

27. An image-forming apparatus according to claim 26, wherein said conductor terminal is connected to means for driving said image-forming means, said driving means being arranged on the cabinet side.

28. An image-forming apparatus comprising:

an envelope;

image forming means disposed within said envelope, wherein said envelope has a recess on an outer wall thereof and a feed-in electrode is arranged in the recess and electrically connected to said image-forming means;

a conductor terminal connected to said feed-in electrode; and a cabinet for holding said envelope, wherein said conductor terminal is connected to means for driving said image-forming means, said driving means being arranged on a cabinet side.

29. An image-forming apparatus comprising:

an envelope;

image forming means disposed within said envelope, wherein said envelope has a recess on an outer wall thereof and a feed-in electrode is arranged in the recess and electrically connected to said image-forming means, wherein said image-forming means includes an electron source and an image-forming member for forming an image when irradiated with electrons emitted from said electron source, wherein said feed-in electrode is connected to an electrode for applying a voltage to said image-forming member;

a cabinet for holding said envelopes; and a conductor terminal arranged on a cabinet side connected to said feed-in electrode.

30. An image-forming apparatus according to claim 29, wherein said conductor terminal is connected to a voltage source for applying a voltage to said image-forming member, said voltage source being arranged on -the cabinet side.

31. An image-forming apparatus comprising:

an envelope;

image forming means disposed within said envelope, wherein said envelope has a recess on an outer wall thereof and a feed-in electrode is arranged in the recess and electrically connected to said image-forming means, wherein said image-forming means includes an electron source and an image-forming member for forming an image when irradiated with electrons emitted from said electron source, wherein said feed-in electrode is connected to an electrode for applying a voltage to said image-forming member;

a conductor terminal connected to said feed-in electrode; and a cabinet for holding said envelope; wherein said conductor terminal is connected to the voltage source for applying a voltage to said image-forming member, said voltage source being arranged on a cabinet side.

* * * * *

UNITED STATES PATENT AND TRADEMARK OFFICE

CERTIFICATE OF CORRECTION

PATENT NO. : 6,114,804

DATED : September 5, 2000

INVENTOR(S): TOSHIMITSU KAWASE, ET AL.

It is certified that error appears in the above-identified patent and that said Letters Patent is hereby corrected as shown below:

COLUMN 5:

Line 14, "forcing" should read --forming--.

COLUMN 8:

Line 3, "element" should read --elements--.

COLUMN 11:

Line 6, "303" should read --3-3--.

COLUMN 12:

Line 44, "the is electron" should read --the electron--.
Line 52, "lam" should read --lcm--.

COLUMN 13:

Line 14, "imp-cane" should read --impedance--.
Line 20, "Z'(=R')." should read --Z'(≅R').--.
Line 31, "Z'(+R')." should read --Z'(≅R').

UNITED STATES PATENT AND TRADEMARK OFFICE

CERTIFICATE OF CORRECTION

PATENT NO. : 6,114,804

DATED : September 5, 2000

INVENTOR(S): TOSHIMITSU KAWASE, ET AL.

It is certified that error appears in the above-identified patent and that said Letters Patent is hereby corrected as shown below:

COLUMN 14:

Line 24, "n the" should read --and the--.
Line 27, "an they" should read --as they--.
Line 50, "produced. In" should read --produced in--.

COLUMN 15:

Line 39, "electron-omitting" should read --electron-emitting--.
Line 66, "image-for g" should read --image forming--.

COLUMN 17:

Line 14, "biked" should read --baked--.
Line 52, "device 23" should read --device electrodes 21, 22, the X- and Y-directional wires 25, 23--.

COLUMN 18:

Line 18, "biked" should read --baked--.
Line 58, "glans," should read --glass.--.

UNITED STATES PATENT AND TRADEMARK OFFICE

CERTIFICATE OF CORRECTION

PATENT NO. : 6,114,804

DATED : September 5, 2000

INVENTOR(S): TOSHIMITSU KAWASE, ET AL.

It is certified that error appears in the above-identified patent and that said Letters Patent is hereby corrected as shown below:

COLUMN 19:

Line 46, "m by" should read --member by--.

COLUMN 20:

Line 13, "fluoreocers" should read --fluorescers--.

COLUMN 21:

Line 54, "as s" should read --as a--.

COLUMN 22:

Line 1, "there" should read --these--.
Line 53, "to that" should read --so that--.

COLUMN 23:

Line 41, "electroconductrve" should read --electroconductive--.
Line 49, "to the ground" should read --to ground--.

UNITED STATES PATENT AND TRADEMARK OFFICE

CERTIFICATE OF CORRECTION

PATENT NO. : 6,114,804

DATED : September 5, 2000

INVENTOR(S): TOSHIMITSU KAWASE, ET AL.

It is certified that error appears in the above-identified patent and that said Letters Patent is hereby corrected as shown below:

COLUMN 24:

Line 35, "where in" should read --wherein--.

COLUMN 25:

Line 18,"envelopes;" should read --envelope;--.
Line 24, "-the" should read --the--.

Signed and Sealed this

Eighth Day of May, 2001

*Attest:*

Nicholas P. Godici

NICHOLAS P. GODICI

*Attesting Officer*

*Acting Director of the United States Patent and Trademark Office*